US009658566B2

(12) United States Patent
Shindo et al.

(10) Patent No.: US 9,658,566 B2
(45) Date of Patent: May 23, 2017

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Go Shindo, Mishima (JP); Takayoshi Kihara, Mishima (JP); Bunro Noguchi, Suntou-gun (JP); Shogo Satomura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/493,586

(22) Filed: Sep. 23, 2014

(65) Prior Publication Data

US 2015/0086227 A1 Mar. 26, 2015

(30) Foreign Application Priority Data

Sep. 24, 2013 (JP) ..... 2013-197215
Jul. 28, 2014 (JP) ..... 2014-152906

(51) Int. Cl.
*G03G 15/08* (2006.01)
*G03G 15/00* (2006.01)

(52) U.S. Cl.
CPC ..... *G03G 15/086* (2013.01); *G03G 15/80* (2013.01)

(58) Field of Classification Search
CPC ..... G03G 15/086; G03G 15/80
See application file for complete search history.

(56) References Cited

U.S. PATENT DOCUMENTS

| | | | | |
|---|---|---|---|---|
| 6,512,895 | B2 * | 1/2003 | Sakurai et al. | 399/13 |
| 2002/0012542 | A1 * | 1/2002 | Karakama et al. | 399/27 |
| 2003/0123888 | A1 * | 7/2003 | Naito et al. | 399/27 |
| 2013/0022368 | A1 * | 1/2013 | Takarada et al. | 399/110 |
| 2013/0114972 | A1 * | 5/2013 | Takarada et al. | 399/110 |
| 2013/0170851 | A1 * | 7/2013 | Takarada et al. | 399/90 |
| 2013/0177334 | A1 * | 7/2013 | Nonaka et al. | 399/111 |
| 2014/0064785 | A1 * | 3/2014 | Takarada | 399/111 |

FOREIGN PATENT DOCUMENTS

| | | | | |
|---|---|---|---|---|
| JP | 2001-117346 A | | 4/2001 | |
| JP | 2002-040906 A | | 2/2002 | |
| JP | 2003-248371 A | | 9/2003 | |
| JP | 2012063750 A | * | 3/2012 | G03G 21/18 |

* cited by examiner

*Primary Examiner* — David Gray
*Assistant Examiner* — Carla Therrien
(74) *Attorney, Agent, or Firm* — Canon U.S.A. Inc., IP Division

(57) ABSTRACT

The present disclosure relates a developer container for accommodating a developer. The developer container includes a conductive path.
The conductive path includes a resin.

27 Claims, 25 Drawing Sheets

DEVELOPER CONTAINER, DEVELOPING DEVICE, PROCESS CARTRIDGE, AND IMAGE FORMING APPARATUS

BACKGROUND OF THE INVENTION

Field of the Invention

The present invention relates to an image forming apparatus, such as a copier, a printer, and a facsimile machine, and to a developer container, a developing device, and a process cartridge for use in the image forming apparatus.

Description of the Related Art

An image forming apparatus employing an electrophotographic process includes a developing device that forms a developer image by supplying a developer to an electrostatic latent image formed by scanning exposure performed on an image carrier. Nowadays, the developing device is often integrally accommodated as a process cartridge together with the image carrier and other process units (e.g., charging member). When they are integrally formed as the process cartridge and this process cartridge is detachably attached to a main body of the apparatus, as described above, an operation of supplying the developer and a maintenance operation are facilitated.

In this process cartridge system, when the developer runs out, a user replaces the cartridge and replenishes the developer, thus enabling the apparatus to be able to form an image again. Such an image forming apparatus typically includes a unit configured to detect a state where the developer has run out and signal a user to replace it, that is, a developer remaining amount detecting unit.

One example of the developer remaining amount detecting unit is the one employing a plate antenna process proposed in Japanese Patent Laid-Open No. 2001-117346. This process uses a pair of input-side and output-side electrodes, measures capacitance between both of the electrodes, and detects the amount of the developer.

Japanese Patent Laid-Open No. 2003-248371 proposes a configuration in which a developer bearing member is considered as an input-side electrode by application of an alternating-current bias thereto and a capacitance detector being an output-side electrode is arranged in a location opposed to the developer bearing member inside a developing device.

The capacitance between the capacitance detector and the developer bearing member employs changing in accordance with the amount of the developer, for example, insulating toner. That is, if a space between the capacitance detector and the developer bearing member is filled with the developer, the capacitance therebetween is large. As the amount of the developer reduces, the proportion of air that occupies the space therebetween increases and the capacitance decreases. Accordingly, if a relationship between the amount of the developer and the capacitance between the developer bearing member and metal plates being the capacitance detector or the capacitance between the metal plates and is determined in advance, the present amount of the developer in the developing device in use can be detected by measurement of the capacitance.

Japanese Patent Laid-Open No. 2002-40906 discloses, as a method of fixing a plate antenna, a case where an antenna member is affixed to a cartridge frame using two-sided adhesive tape and a configuration in which processing, such as depositing or printing, is directly performed on the frame. In addition, that patent literature also discloses a configuration in which the frame and the electrodes are formed by coinjection molding using a resin for forming the frame and a conductive resin for the electrodes.

The above-described techniques of detecting the amount of the developer by measuring the capacitance between the electrodes need metal wiring from the detection electrodes. The arrangement of that wiring tends to be complex.

SUMMARY OF THE INVENTION

The present invention provides a developer container for accommodating a developer. The developer container includes a frame, a detecting member, and a conductive path. The detecting member is disposed on the frame and configured to detect an amount of the developer based on a change in capacitance. The conductive path is connected to the detecting member. The conductive path includes a resin.

The present invention provides a developer container for accommodating a developer. The developer container includes a frame, a detecting member, and a conductive path. The detecting member is configured to detect an amount of the developer based on a change in capacitance. The conductive path is configured to transmit a detection signal detected by the detecting member. The frame has a side wall surface intersecting a longitudinal direction of the detecting member on a side where the developer is accommodated. At least part of the conductive path is positioned outside the side wall surface in the longitudinal direction, and the conductive path includes a resin.

The present invention provides a developing device, a process cartridge, and an image forming apparatus.

With the present invention, the use of the resin in the conductive path can simplify the structure.

Further features of the present invention will become apparent from the following description of exemplary embodiments with reference to the attached drawings.

DESCRIPTION OF THE EMBODIMENTS

First Embodiment

A developer container including a developer remaining amount detecting unit, a developing device, a process cartridge, and an image forming apparatus are described in detail below with reference to the drawings.

Figure 2:
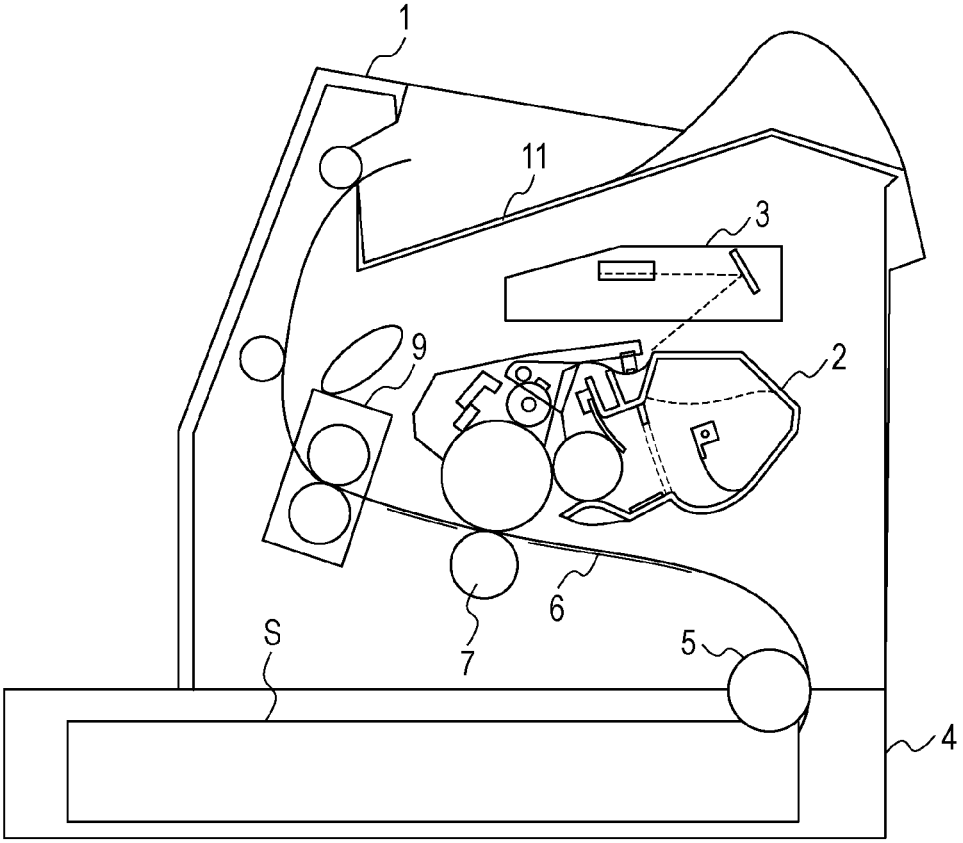
FIG. 2 is a schematic diagram of an image forming apparatus according to the first embodiment.

(1) Outline of Configurations and Operations of Image Forming Apparatus and Process Cartridge FIG. 2 is a schematic diagram of an image forming apparatus according to the present embodiment. The image forming apparatus is an electrophotographic laser beam printer with a detachable process cartridge. When this printer is connected to an external host apparatus, such as a personal computer or an image reading apparatus, it can receive image information and print the image.

Figure 3:
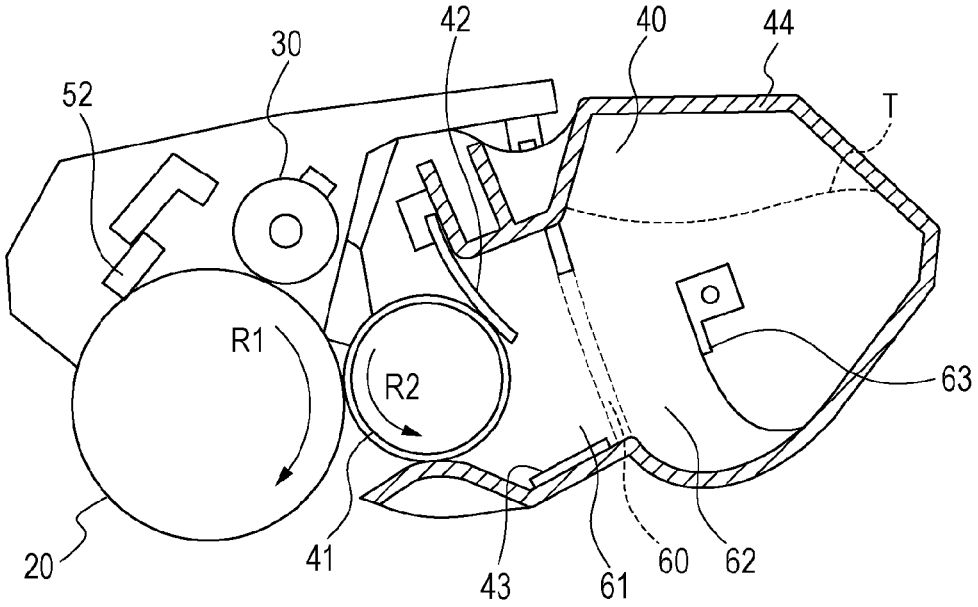
FIG. 3 is a cross-sectional view of a process cartridge according to the first embodiment.

A process cartridge 2 is detachable from a main body 1 of a printer (main body of the image forming apparatus). FIG. 3 is a cross-sectional view of a process cartridge according to the first embodiment. The process cartridge 2 is described with reference to FIG. 3.

In FIG. 3, four kinds of process devices consisting of a drum-type electrophotographic photosensitive member (hereinafter referred to as photosensitive drum) 20 as an image carrier, a charging device 30, a developing device 40, and a cleaning device 52 are integral in a cartridge form in the present embodiment, and the process cartridge is detachable from the main body 1 of the printer.

The photosensitive drum 20 is rotatable in a clockwise direction indicated by the arrow R1 with a circumferential speed (process speed) of 157.6 mm/s on the basis of a print start signal. In the present embodiment, a roller charging technique is used in the charging device 30. The photosensitive drum 20 is in contact with the charging device 30 configured to receive an applied charging bias. The charging device 30 follows the photosensitive drum 20 and is rotated. The charging device uniformly charges the circumferential surface of the rotating photosensitive drum 20 to a predetermined polarity and potential. In the present embodiment, it is charged to a negative predetermined potential.

An exposure device 3 is configured to output laser light modulated (on/off converted) in response to a time-series electrical digital pixel signal of image information input from a host apparatus to a controller section and perform scanning exposure on the drum surface of the photosensitive drum 20 uniformly charged by the charging device 30. In the present embodiment, an image exposure method of exposing an image information section is used.

An electrostatic latent image formed on the drum surface by that scanning exposure is developed by a developer on a developing sleeve (developing roller) 41 as a developer bearing member in the developing device 40.

A pickup roller 5 in a sheet tray section 4 is driven at a predetermined control timing, and one of recording materials (sheets) S being recording media stacked and contained in the sheet tray section 4 is separated and transported. In the course where the recording material S passes by a transfer roller 7 through a transfer guide 6, developer images (hereinafter referred to as toner images) borne on the surface of the photosensitive drum 20 are sequentially transferred to the surface of the recording material S. After that, the recording material S is subjected to heating, pressing, and fixing for the toner images in a fixing device 9, and it is ejected to an output tray 11. The cleaning device 52 cleans a residual substance, such as transfer-residual toner, off the photosensitive drum surface separated from the sheet material. The photosensitive drum surface is used for image formation starting from charging again, and this process is repeated.

(2) Developing Device

Figure 1:
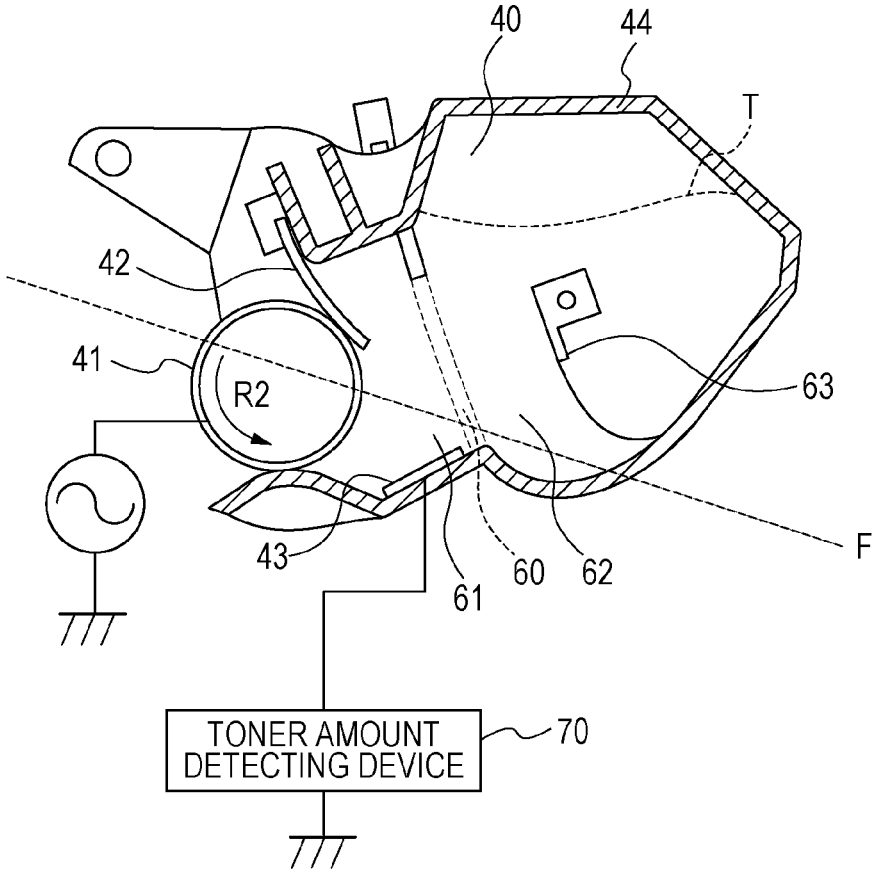
FIG. 1 is a cross-sectional view of a developing device according to a first embodiment.

FIG. 1 is a cross-sectional view of the developing device according to the first embodiment.

The developing device 40 in the present embodiment includes a developing chamber 61 having an aperture 60 and allowing the developing sleeve 41 disposed therein to be rotated and a developer accommodation section (hereinafter referred to as toner chamber) 62 accommodating the developer (hereinafter referred to as toner T or toner). The developing device 40 is configured as a developing device (or developing unit) separately provided from a cleaning unit.

The mono-component magnetic toner T in the toner chamber is conveyed to the developing chamber 61 through the toner supply aperture 60, which is a communicating port between the toner chamber 62 and the developing chamber 61, by a toner agitator 63, which is a conveying unit and an agitating unit. The toner T in the developing chamber 61 is attracted to the developing sleeve 41 by a magnet (not illustrated) disposed in the developing sleeve 41. With rotation of the developing sleeve 41 in a direction indicated by R2, the developer is conveyed toward a developer regulating member (developing blade) 42 made of an elastic member. The developing blade 42 adds triboelectricity to the developer and regulates the layer thickness of the developer. The developer is conveyed toward the photosensitive drum 20.

Here, a developing bias in which an alternative-current voltage (peak-to-peak voltage=1600 Vpp, frequency f=2400 Hz) is superimposed on a direct-current voltage (Vdc=−400 V) from the main body of the image forming apparatus is applied to the developing sleeve 41. The photosensitive drum 20 is grounded, and an electric field occurs in a region opposed to the developing sleeve 41 in accordance with the developing bias. As a result, the latent image on the surface of the photosensitive drum 20 is developed as a developer image by the above-described charged toner.

Figure 4:
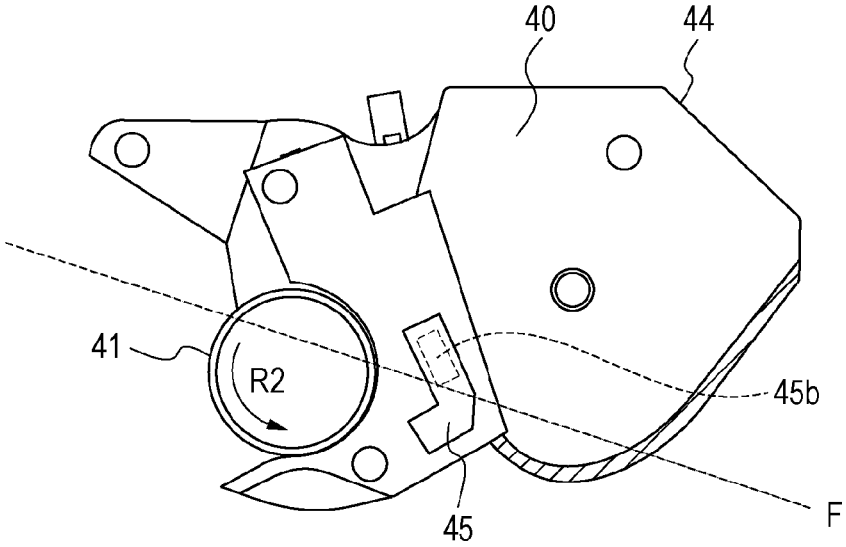
FIG. 4 is an outer side view of a developing frame according to the first embodiment.
Figure 7A:
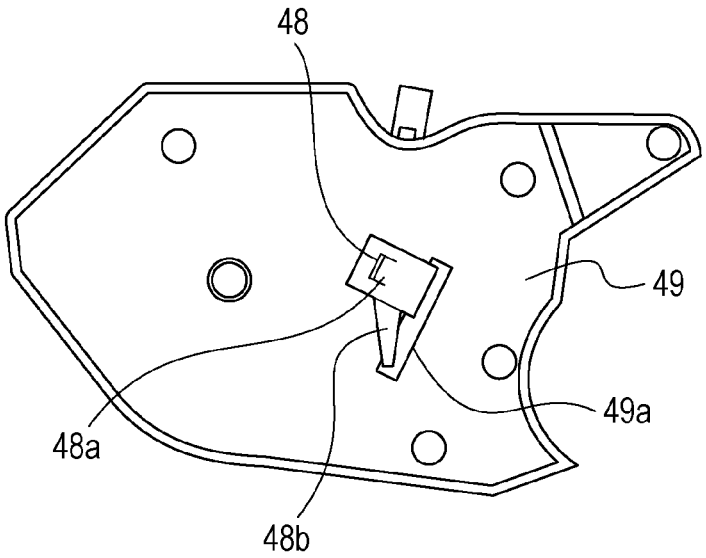
FIGS. 7A and 7B illustrate the developing frame of a side holder and a resin according to the first embodiment.
Figure 7B:
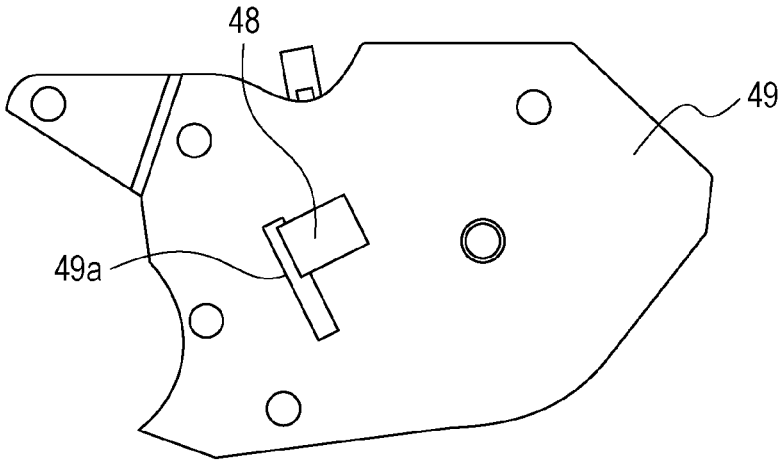

Next, the developer remaining amount detecting unit in the present embodiment is described with reference to FIGS. 1, 4, 7A, and 7B. FIG. 4 is an outer side view of a developing frame according to the first embodiment. FIG. 7A illustrates an inner portion of a side holder resin-bonded to the developing frame in the first embodiment. FIG. 7B illustrates an outer portion of the side holder not resin-bonded to the developing frame in the first embodiment.

As the developer remaining amount detecting unit and as a detecting member for detecting a capacitance, a conductive antenna member 43 is disposed. When an AC voltage is applied to the developing sleeve 41, a current is induced between the developing sleeve 41 and the antenna member 43 in accordance with a capacitance therebetween. Similarly, a current is also induced between the developing sleeve 41 and an output conductive path 45 in accordance with a capacitance therebetween. Here, the capacitance between the developing sleeve 41 and the antenna member 43 is referred to as an actual capacitance, and the capacitance between the developing sleeve 41 and the output conductive path 45 is referred to as a stray capacitance. The actual capacitance varies with the amount of the toner between the developing sleeve 41 and the antenna member 43 (hereinafter referred to as the amount of the toner). The stray capacitance varies with the amount of the toner between the developing sleeve 41 and the output conductive path 45. These two capacitances vary with the respective amounts of the toner, and a current corresponding to the sum of the actual capacitance and the stray capacitance is transmitted as a single signal to a developer amount detecting device (toner amount detecting device) 70.

That is, a detection signal (current) flowing from the antenna member 43 and the output conductive path 45 is transmitted to the toner amount detecting device 70 in the main body 1 of the image forming apparatus through a contact electrode 48 on a side holder 49. The amount of the toner inside the developing device 40 can be sequentially estimated (detected) by measurement conducted by the toner amount detecting device 70.

In the present embodiment, the developing sleeve is used as one electrode. However, another electrode different from the developing sleeve may also be disposed. That is, a separate electrode for detecting the amount of the developer using the capacitance may be disposed in a location opposed to the detecting member. The developing sleeve may not be used as the electrode.

Figure 5:
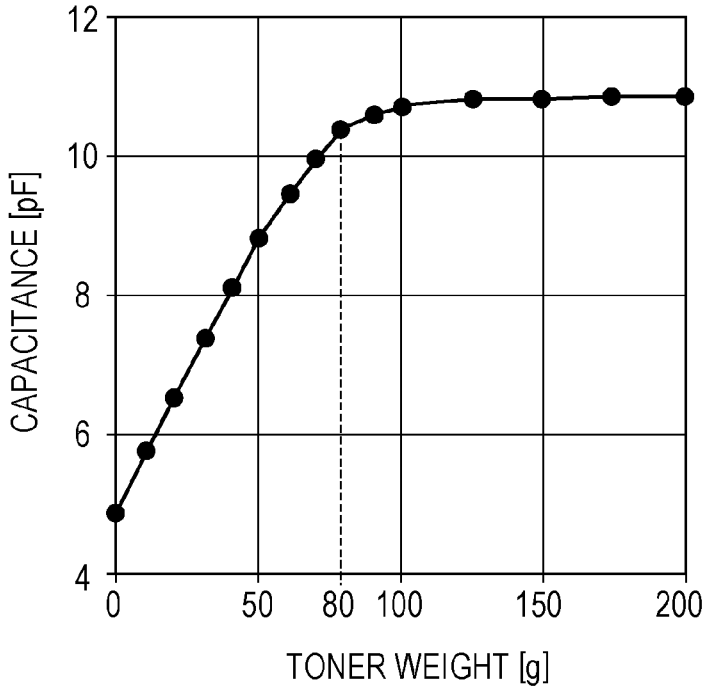
FIG. 5 illustrates a relationship between the amount of a toner and a capacitance inside the developing device when the detecting member and the output conductive path are arranged in a center of positional tolerance according to the first embodiment.

As illustrated in FIG. 1, because the antenna member 43 is disposed on the bottom surface of a developing frame 44, a change in the amount of the toner in the developing device 40 can be determined. FIG. 5 illustrates a relationship between the amount of the toner and a capacitance inside the developing device when the antenna member and the output conductive path are arranged in a center of positional tolerance. In FIG. 5, the horizontal axis indicates the remaining amount of the developer (hereinafter referred to as toner remaining amount), and the vertical axis indicates the capacitance corresponding to each toner remaining amount. In the present embodiment, as illustrated in FIG. 5, a user can be informed of the toner remaining amount and be signaled to replace the toner using changes in capacitance from the time when the toner is consumed and the amount of the toner is on the order of 80 g to the time when the toner runs out. Because the amount of the toner between the antenna member 43 and the developing sleeve 41 starts changing when it is 80 g, the capacitance remains unchanged in a region where the amount of the toner is larger than 80 g. The antenna member can be disposed in any location where the toner remaining amount can be measured efficiently in accordance with the shape of the container.

(2-1) Configuration of Detecting Member (Antenna Member)

Figure 6:
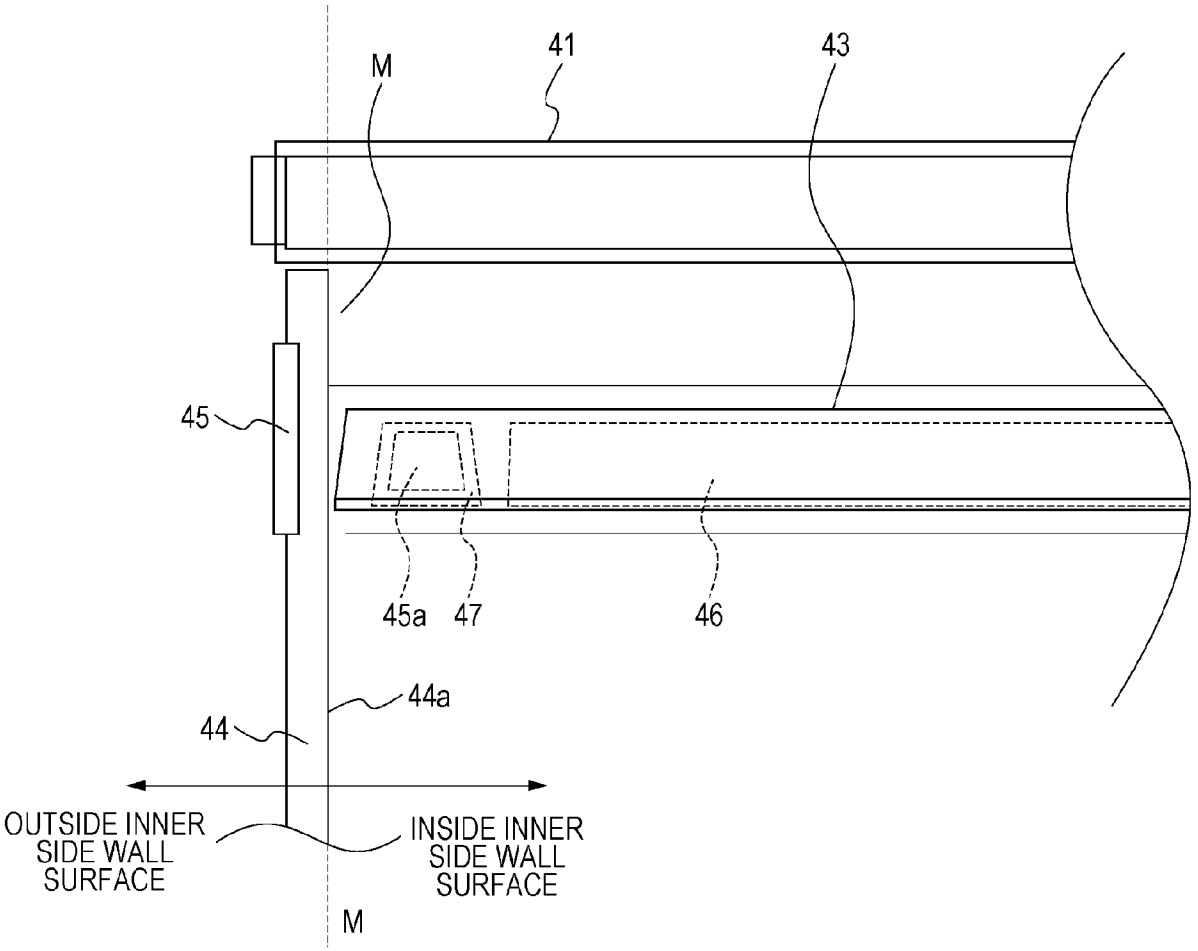
FIG. 6 is a schematic diagram of the detecting member in the developing device according to the first embodiment.

The configuration of the antenna member 43 is described below. FIG. 6 is a cross-sectional view that schematically illustrates the antenna member in the developing device according to the first embodiment. FIG. 6 is a cross-sectional view taken along the dotted line F in FIGS. 1 and 4.

The antenna member 43 is formed by affixing a stainless steel plate to part of the bottom surface of the developing frame 44 using two-sided adhesive tape 46 such that it faces the developing sleeve 41. That is, in the present embodiment, the stainless steel plate is used as the antenna member. The antenna member 43 is conducted to the output conductive path 45 through two-sided adhesive tape 47 on an end where the output conductive path 45 is present. Any conductive member can be selected as the antenna member 43. Other than the conductive two-sided adhesive tape, a direct contact using a leaf spring or conductive grease may also be used in the conduction with the output conductive path 45 when it can achieve the conduction.

Here, the details of the antenna member and the output conductive path are described. The antenna member is a conductive member and is disposed in a location where it can detect the capacitance varying with a change in the amount of the toner. Thus in the present embodiment, the antenna member is disposed in a location that is opposed to the developing sleeve and that is inside the inner wall surface of the developing frame accommodating the toner. The antenna member may be made up of a plurality of conductive members. As described below, the antenna member may be a conductive resin sheet. For example, a conductive resin sheet that is made conductive by dispersing carbon black in polystyrene resin (hereinafter referred to as PS resin). The resin is not limited to the polystyrene resin and may be an ethylene-vinyl acetate resin (hereinafter referred to as EVA resin). The conductive resin sheet may be made of a single layer or a plurality of layers. In the first embodiment, as illustrated in FIG. 6, the antenna member is arranged inside a side wall surface 44*a* of the developing frame 44 on the side where the developer is accommodated. That is, the antenna member is located inside the dotted line M.

The output conductive path is a conductive member including a resin and is configured to transmit a signal received by the antenna member. The output conductive path is also arranged in a portion outside the inner side wall surface to enable the signal from the antenna member to be transmitted outside the apparatus. In the present embodiment, the inclusion of the resin in the conductive path located outside the inner side wall surface can reduce variations in positional accuracy and dimensional accuracy of parts.

Part of the conductive path extends to the inside of the frame and is arranged so as to enable electrical connection between the side where the developer is accommodated in the frame and its opposite side. Thus part of the conductive path may be exposed to the side wall on the side where the developer is accommodated in the frame and its opposite side, depending on the use. As described below, the configurations in which part of the conductive path is exposed illustrated in FIGS. 26A, 26B, 27A, and 27B may also be used. Because the frame includes the resin, the frame and the conductive path can be integrally formed by resin molding. Thus ease of assembly can be promoted.

(2-2) Configuration of Contact Electrode

The configuration of the contact electrode is described below. FIG. 7A illustrates an inner portion of the side holder resin-bonded to the developing frame in the first embodiment. FIG. 7B illustrates an outer portion of the side holder not resin-bonded to the developing frame in the first embodiment.

The contact electrode 48 is fixed by fitting a copper electrode plate into a convex boss in the side holder 49. A convex boss fitting section 48*a* in the contact electrode 48 is formed from a cut having a substantially rectangular U shape in the contact electrode 48. The contact electrode 48 is bent so as to pass through a side-holder hole 49*a*. Resin-bonding the side holder 49 to the developing frame 44 causes an output conductive path contacting section 48*b* having a leaf spring shape in the contact electrode 48 to be in contact with a contact-electrode contacting section 45*b* of the output conductive path 45 illustrated in FIG. 4, thus enabling the conduction. In addition, the contact electrode 48 includes a contacting section being in contact with the main body 1 of the image forming apparatus. Thus when the process cartridge is attached to the main body, a signal from the antenna member 43 and the output conductive path 45 can be transmitted to the toner amount detecting device 70 in the main body 1 of the image forming apparatus.

(2-3) Configuration of Output Conductive Path and Developing Frame

Next, the output conductive path 45 and the developing frame 44, which are characteristic of the present embodiment, are described in detail.

[Method of Forming Output Conductive Path]

Figure 8:
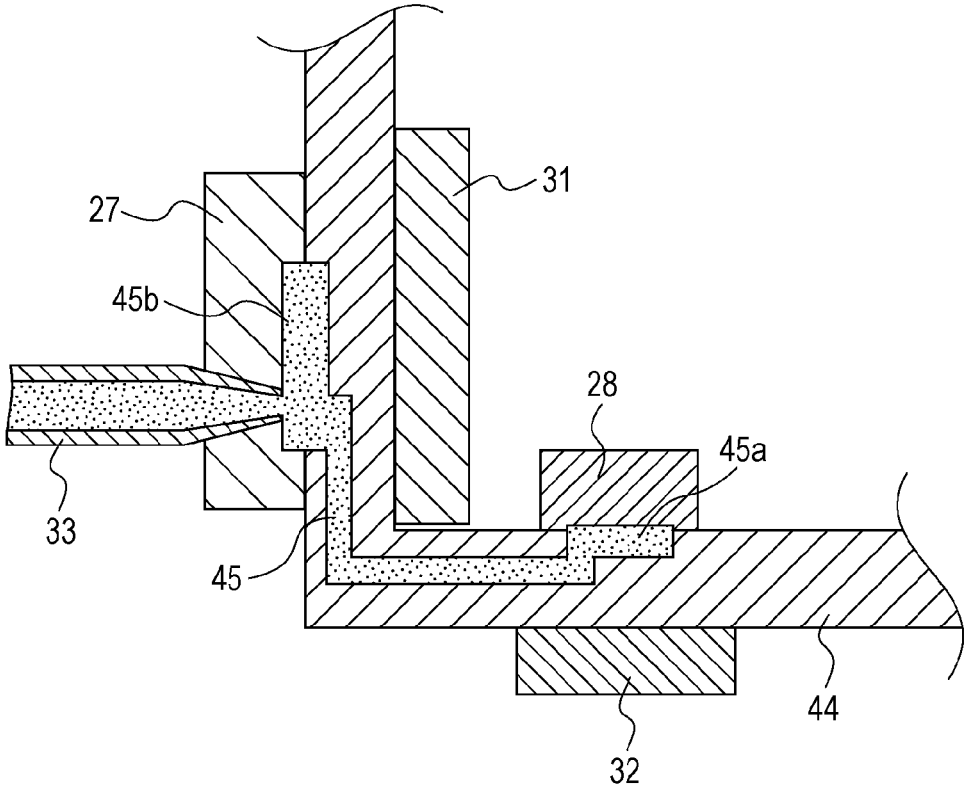
FIG. 8 is a schematic cross-sectional view that illustrates a state where dies brought into contact with the developing frame are clamped thereto in integrally molding the output conductive path to the developing frame according to the first embodiment.
Figure 9:
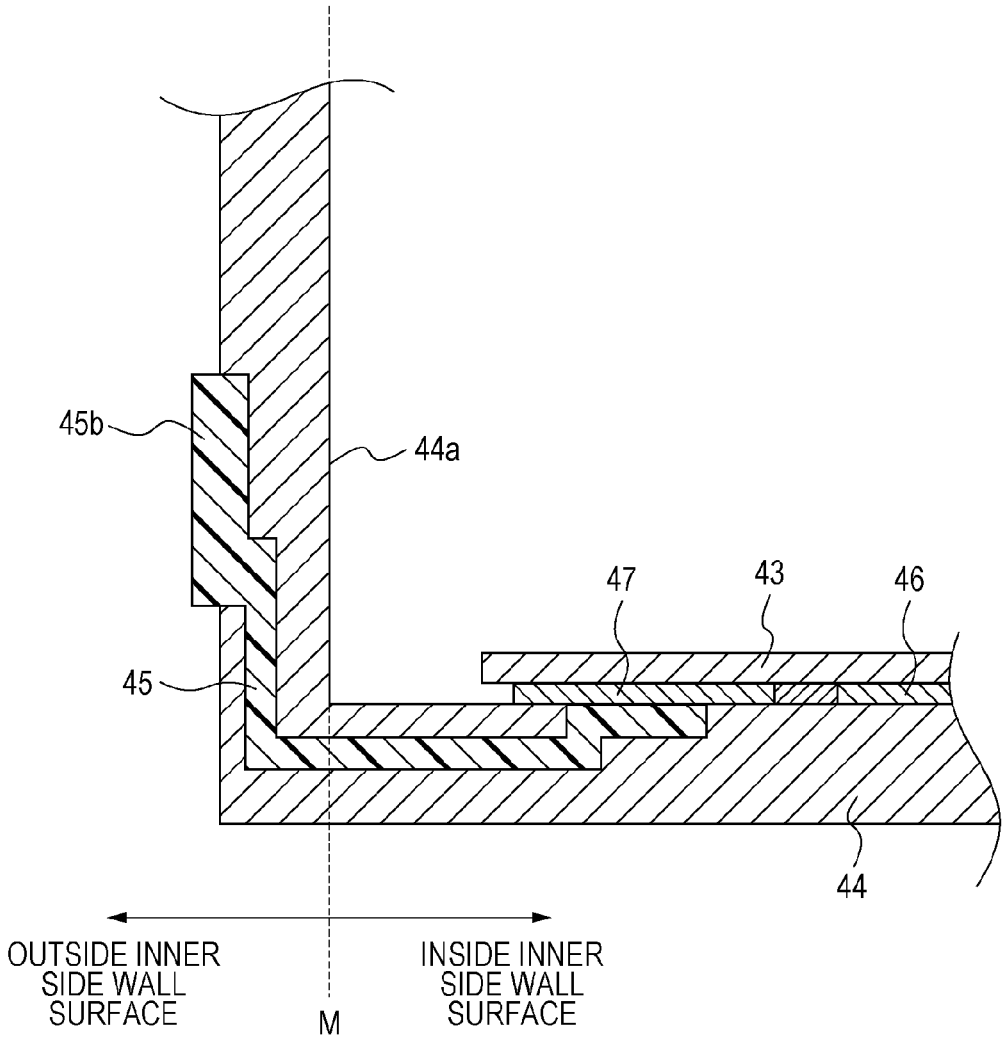
FIG. 9 is a schematic cross-sectional view of the output conductive path and the developing frame according to the first embodiment.

A method of forming the output conductive path 45 is described below. FIG. 4 is a side view of the developing frame in the first embodiment. FIG. 6 schematically illustrates the antenna member in the developing device according to the first embodiment. FIG. 8 is a schematic cross-sectional view that illustrates a state where dies brought into contact with the developing frame are clamped thereto in integrally molding the output conductive path to the developing frame according to the first embodiment. FIG. 9 is a schematic cross-sectional view of the output conductive path and the developing frame according to the first embodiment.

The output conductive path 45 is formed using a space (output conductive path forming section) between the developing frame 44 and each of dies 27 and 28. The output conductive path is integrally molded with the developing frame 44 by injection of a conductive resin from a gate 33 into the space for forming the output conductive path 45. Here, the output conductive path forming section is the space between the developing frame 44 and each of the dies (27, 28) formed by bringing the dies 27 and 28 into contact with the developing frame 44 and the space inside the developing frame 44 into which the resin is injected.

It is necessary to bring the dies 27 and 28 into contact with the developing frame 44 and clamp them in forming the output conductive path 45. Backup members 31 and 32 support the developing frame 44 from the backsides of the contact surfaces to the respective dies. This aims to avoid the pressing forces of the dies or the resin pressure occurring in the injection of the resin from causing the contact surface of the developing frame 44 to escape or be deformed. In the present embodiment, the backsides of the contact surfaces to the dies are supported. However, any portion other than the backsides may be supported when escape and deformation of the developing frame 44 can be prevented.

As illustrated in FIG. 9, an antenna-member contacting section 45*a*, which is part of the conductive path shaped using the die 28, is in contact with the antenna member 43 through the conductive two-sided adhesive tape 47 disposed therebetween, thus enabling conduction with the antenna member 43. The contact-electrode contacting section 45*b* shaped using the die 27 is in contact with the output conductive path contacting section 48*b* in the contact electrode 48, thus enabling conduction with the contact electrode 48. In the present embodiment, an integrally molding method of injecting a resin into a frame after molding is used. However, an insert molding method or coinjection molding method performed in the same mold at the time of molding the frame may also be used.

As a material of the developing frame 44, high-impact polystyrene (hereinafter referred to as HIPS) is used. A resin such as a carbon-dispersed PS resin or a conductive HIPS resin, is used in the output conductive path 45, and that resin is any resin having compatibility with the HIPS of the developing frame 44. Other material that does not have such compatibility and that has adhesiveness, such as a carbon-dispersed EVA, may also be used.

Next, a comparative example is described.

COMPARATIVE EXAMPLE

Figure 10:
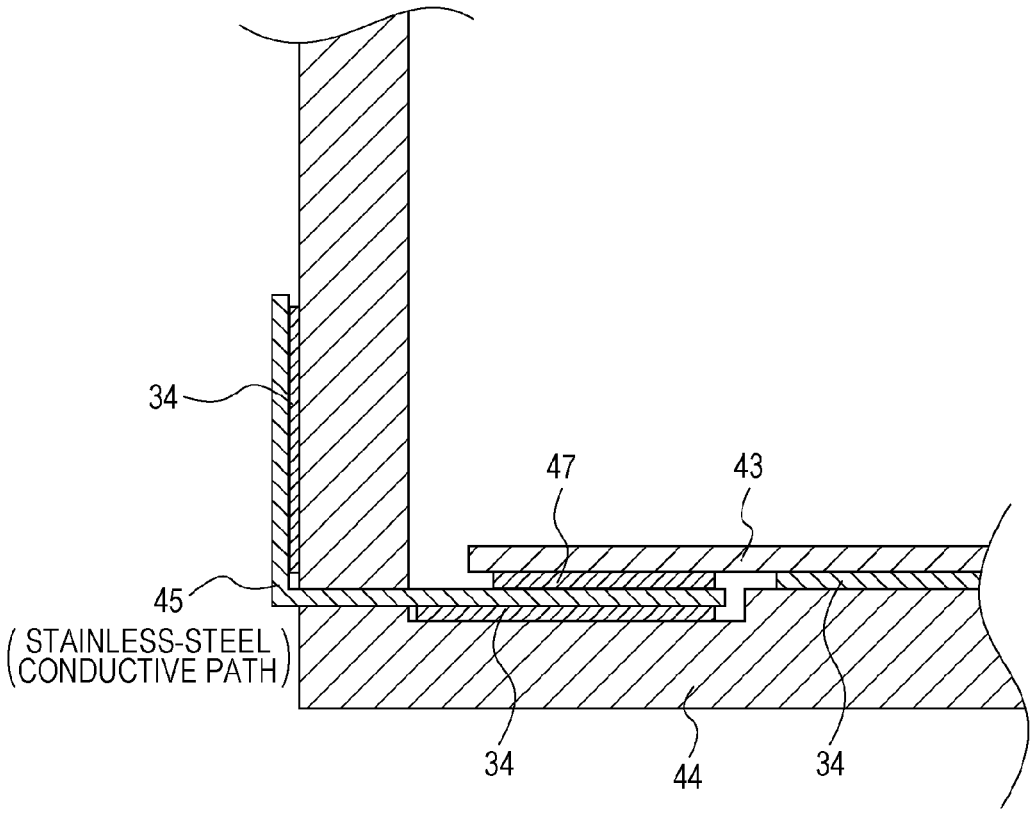
FIG. 10 is a schematic diagram of a configuration in which an output conductive path is affixed using two-sided adhesive tape according to a comparative example.

FIG. 10 is a schematic diagram of a configuration in which an output conductive path is affixed using two-sided adhesive tape according to the comparative example. In the comparative example, the stainless steel output conductive path 45 is fixed to the developing frame 44 after molding using two-sided adhesive tape 34. The same configuration of the antenna member 43 and the contact electrode 48 as in the present embodiment is used. The same conducing method is also used.

A positional tolerance of the output conductive path 45 in the present embodiment and that in the comparative example are compared here. In the present embodiment, the resin of the conductive path is integrally molded with the developing frame 44, which positions the developing sleeve 41. There are a tolerance in a section where the output conductive path 45 and the antenna member 43 are in contact with each other and a tolerance in a section where the output conductive path 45 and the contact electrode 48 are in contact with each other. Thus the positional tolerance in the present embodiment is the sum of the four tolerances consisting of a frame molding tolerance, a resin molding tolerance, the tolerance in the section where the output conductive path 45 and the antenna member 43 are in contact with each other, and the tolerance in the section where the output conductive path 45 and the contact electrode 48 are in contact with each other. In the comparative example, the stainless steel output conductive path 45 is affixed to the developing frame 44, which positions the developing sleeve 41, using the two-sided adhesive tape 34. Thus, there are five tolerances consisting of a frame molding tolerance, a thickness tolerance of the stainless-steel output conductive path 45 and a dimensional tolerance of a bent location thereof, a thickness tolerance of the two-sided adhesive tape 34, and a tolerance of affixation to the developing frame 44. In addition, there are a tolerance in the section where the output conductive path 45 and the antenna member 43 are in contact with each other and a tolerance in the section where the output conductive path 45 and the contact electrode 48 are in contact with each other. Thus the positional tolerance in the comparative example is the sum of the above-described seven tolerances. When the resin is molded using the dies, the molding can be made relatively easily with high positional accuracy by using a uniform condition in injection molding. In contrast, the affixation involves a certain degree of tolerance even when the affixation is made automatically or manually. In the comparative example, in contrast to the first embodiment, there are the thickness tolerance and the bending tolerance of the conductive path and the thickness tolerance of the two-sided adhesive tape, in addition to the affixation tolerance. The positional accuracy is markedly improved by reducing a sum of a plurality of tolerances and by forming the output conductive path 45 by integrally molding of the resin of the conductive path and the frame, in contrast to a known case where the metal conductive path is affixed. That is, the inclusion of the resin in the conductive path enhances the ease of processing, and the thickness tolerance and the dimensional tolerance of the bent location occurring when the stainless steel is used in the conductive path can be reduced. Accordingly, in the present embodiment, the number of locations in which tolerances occur can be reduced, and the positional accuracy can be improved. At the same time, the ease of assembly can be increased, and the structure can be simplified.

Next, the positional tolerance and accuracy of detecting the toner remaining amount in the present embodiment and the comparative example are described. Here, in each of the present embodiment and the comparative example, among the configurations that can be produced, the configuration where the distance between the developing sleeve 41 and the output conductive path 45 is the longest and the configuration where that distance is the shortest are used in the description.

Figure 11A:
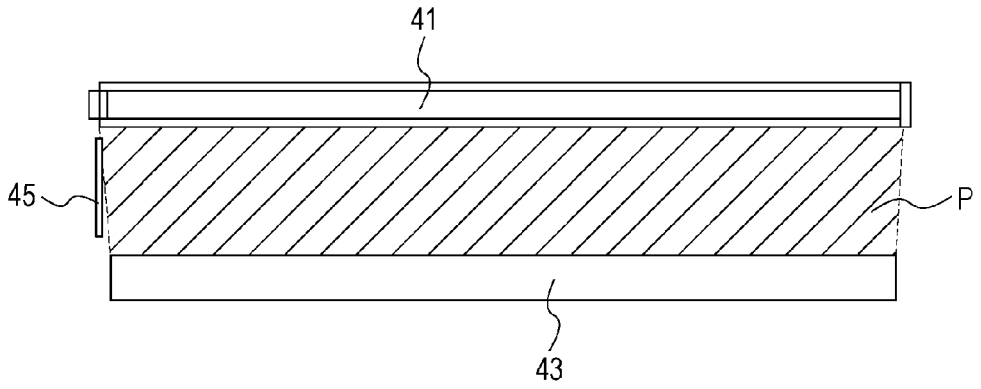
FIGS. 11A and 11B illustrate positions of a developer bearing member, the detecting member, and the output conductive path according to the first embodiment.
Figure 11B:
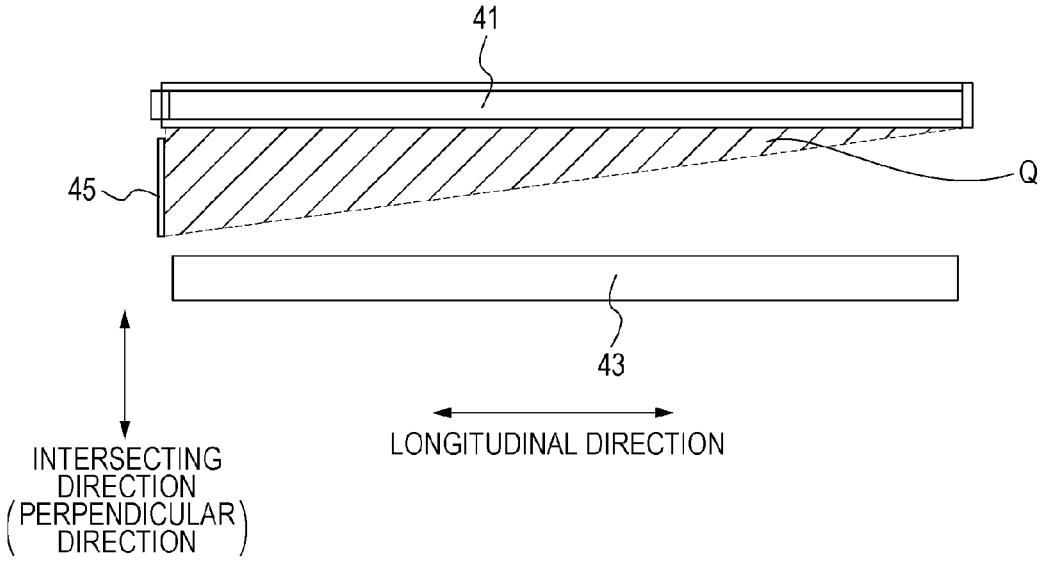

The stray capacitance detected by the output conductive path 45 is the capacitance between the developing sleeve 41 and the output conductive path 45 and is thus dependent on its distance. Thus the accuracies of remaining toner quantity detection can be compared by a comparison between an actual amount of the toner and each of the capacitance in the location where the distance between the developing sleeve 41 and the output conductive path 45 is the longest and the capacitance in the location where that distance is the shortest. FIGS. 11A and 11B illustrate the locations of the developing sleeve, the antenna member, and the output conductive path according to the first embodiment. Part of the output conductive path (first conductive path) intersecting the longitudinal direction of the antenna member is formed. In many cases, part of the conductive path (first conductive path) is arranged in a direction perpendicular to the longitudinal direction of the antenna member in the developing device. A region P illustrated in FIG. 11A is a range where the developing sleeve 41 and the antenna member 43 can detect the toner. A region Q illustrated in FIG. 11B is a range where the developing sleeve 41 and the output conductive path 45 can detect the toner. In the region Q, the capacitance increases or decreases when the amount of the toner is smaller than that in the region P. Thus the effect of variations in the stray capacitance is large when the amount of the toner is small. Because the capacitance increases with a reduction in the distance between the developing sleeve 41 and the output conductive path 45, the major portion of the capacitance is occupied by the amount of the toner in a range in the region Q where the distance between the developing sleeve 41 and the output conductive path 45 is short. The same configuration is used in the comparative example.

Figure 12:
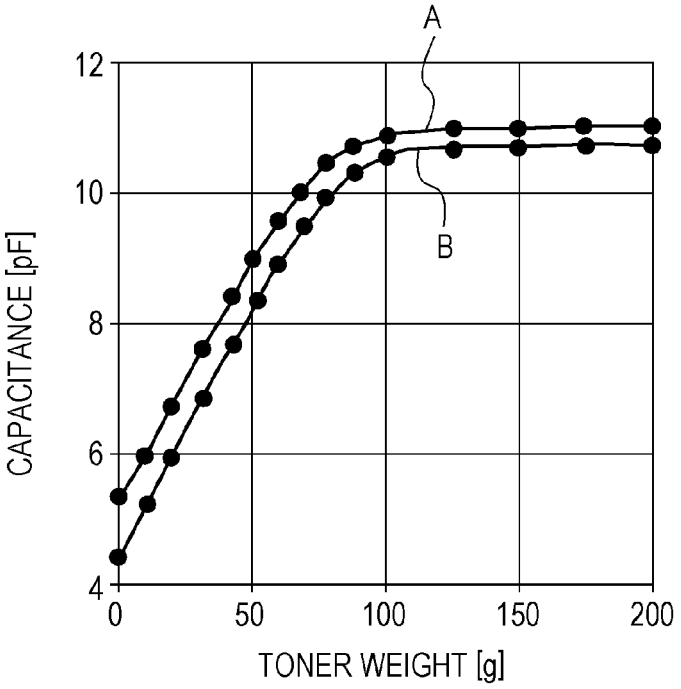
FIG. 12 illustrates a relationship between a capacitance and the amount of the toner in (A) and (B) according to the first embodiment.
Figure 13:
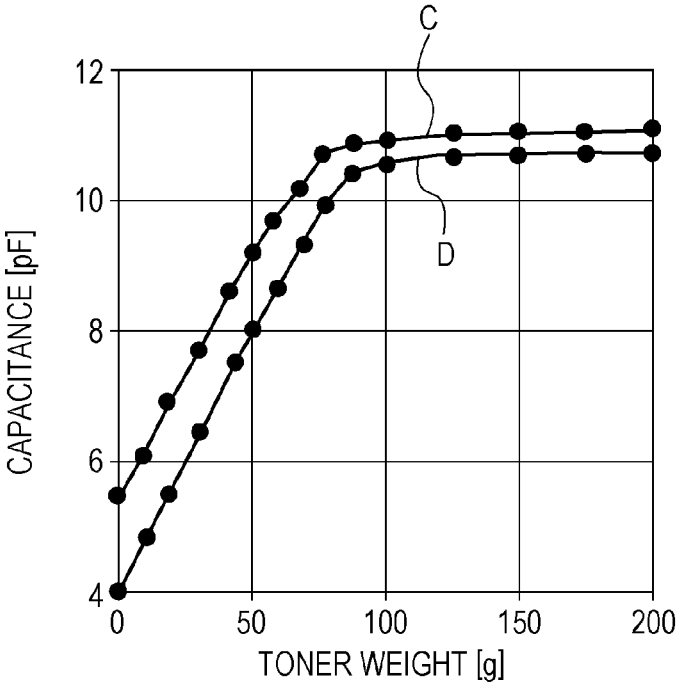
FIG. 13 illustrates a relationship between a capacitance and the amount of the toner in (C) and (D) according to the comparative example.
Figure 14:
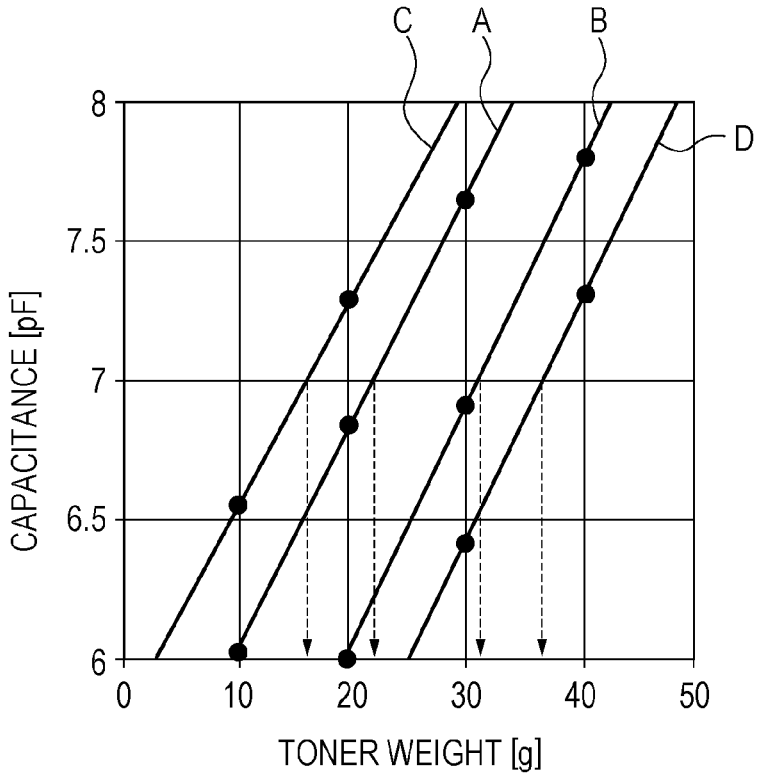
FIG. 14 illustrates a relationship between a capacitance and the amount of the toner in (A) to (D) in a region of 6 to 8 pF according to the first embodiment.

FIG. 12 is a graph of the capacitance and the amount of the toner in the first embodiment. FIG. 13 is a graph of the capacitance and the amount of the toner in the comparative example. FIG. 14 is a graph of the capacitance and the amount of the toner in a region of 6 to 8 pF. In the present embodiment, the configuration in which the distance between the developing sleeve 41 and the output conductive path 45 is the shortest is referred to as (A), and the configuration in which that distance therebetween is the longest is referred to as (B). In the comparative example, the configuration in which the distance between the developing sleeve 41 and the output conductive path 45 is the shortest is referred to as (C), and the configuration in which that distance therebetween is the longest is referred to as (D). The antenna member 43 is attached in the central location in all of the positional tolerances.

In the configurations (A) and (C), where the distance between the developing sleeve 41 and the output conductive path 45 is the shortest, it is large as the capacitance. In the configurations (B) and (D), where the distance between the developing sleeve 41 and the output conductive path 45 is the longest, it is small as the capacitance. This is because large and small stray capacitances cause large and small measured capacitances. For example, as illustrated in FIG. 14, a comparison at a capacitance of 7 pF reveals that variations of 23 g to 32 g occur in the first embodiment and variations of 16 g to 37 g occur in the comparative example. That is, it reveals that the first embodiment achieves higher accuracy of remaining toner quantity detection than the comparative example. Thus the first embodiment can inform a user of a replacement timing with higher accuracy than the comparative example.

That is, in the comparative example, because no resin is used in the conductive path, there are a thickness tolerance, a dimensional tolerance in the bent location, and additionally a thickness tolerance of the two-sided adhesive tape 34 when the stainless steel is used in the conductive path. In contrast to this, in the present embodiment, the conductive path includes the resin, the number of the locations where the tolerances occur can be reduced, and thus the positional accuracy can be improved.

Second Embodiment

Figure 15:
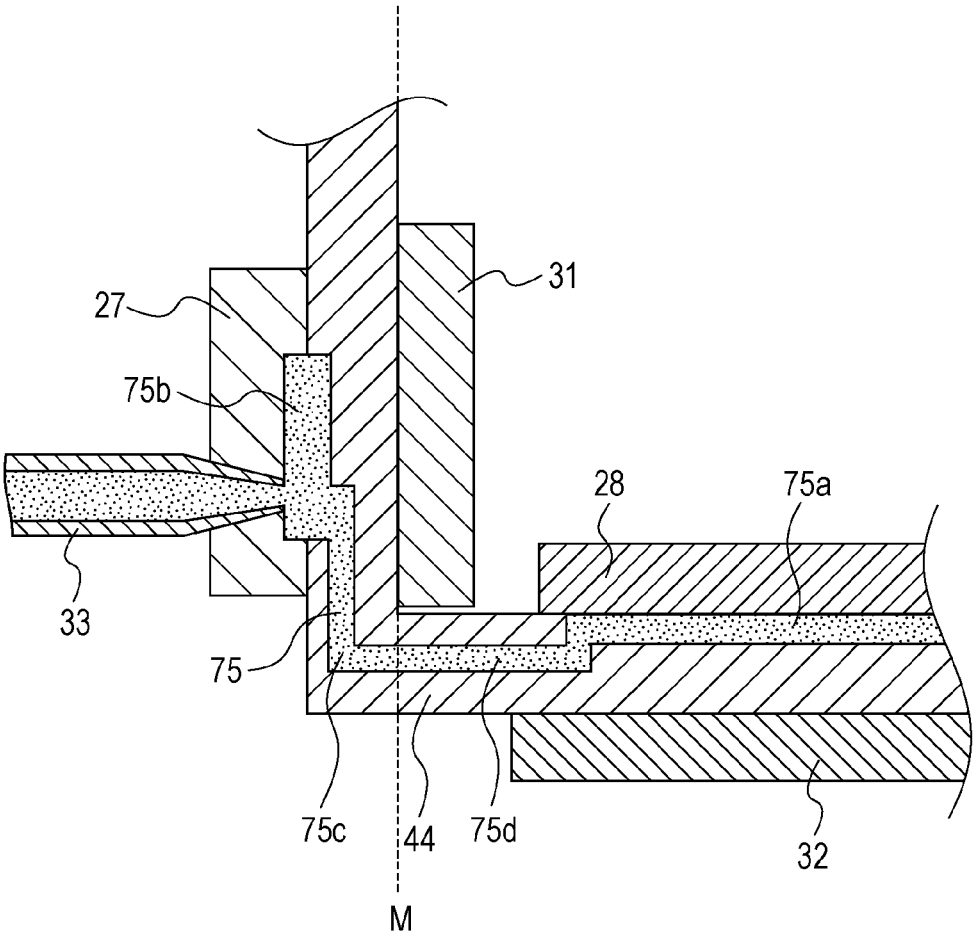
FIG. 15 is a schematic cross-sectional view that illustrates a state where the dies brought into contact with the developing frame are clamped thereto in integrally molding an integral electrode to the developing frame according to a second embodiment.

FIG. 15 is a schematic cross-sectional view that illustrates a state where dies brought into contact with the developing frame are clamped thereto in integrally molding the output conductive path and the antenna member to the developing frame according to a second embodiment.

As illustrated in FIG. 15, the present embodiment is characteristic in that the antenna member 43 and the output conductive path 45 are integrally molded with the frame, unlike the first embodiment. The other respects are substantially the same as in the first embodiment, and redundant respects are not described.

[Method of Integrally Forming Output Conductive Path and Antenna Member]

Figure 16:
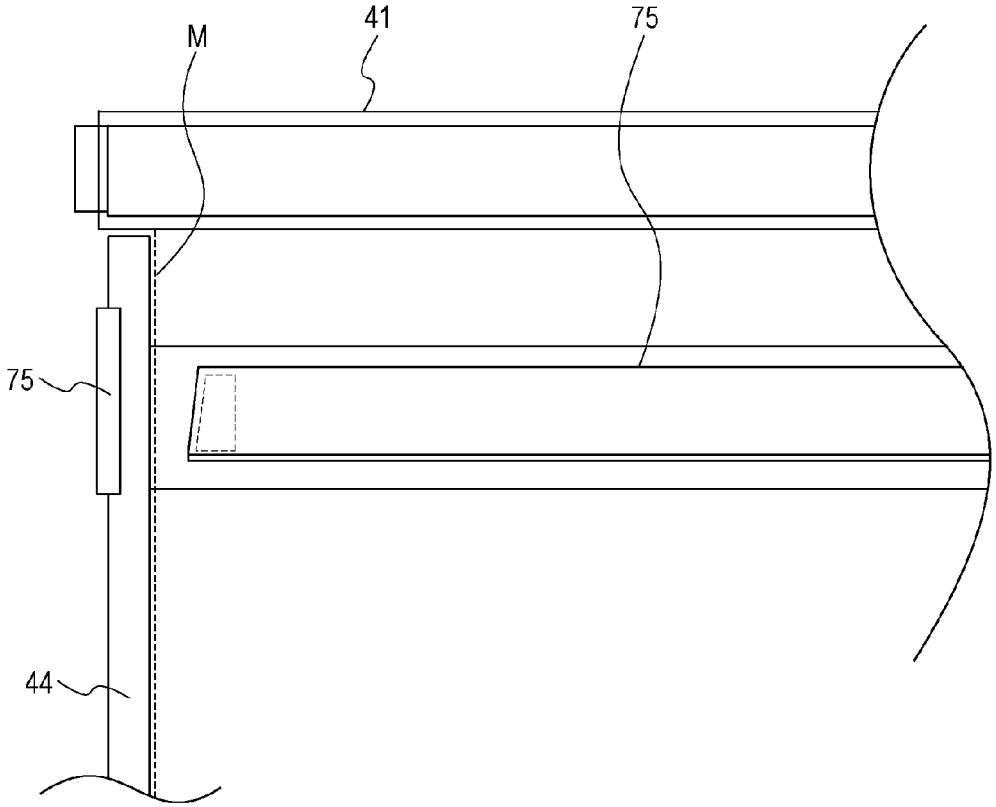
FIG. 16 is a schematic diagram of the integral electrode in the developing device according to the second embodiment.

A method of integrally forming the output conductive path and the antenna member is described below. Hereinafter, a member in which output conductive paths (75*b*, 75*c*) and an antenna member 75*a* are integrally molded is referred to as an integral electrode 75. In the present embodiment, part of the conductive path also extends to the inside of the inner side wall surface and includes a section 75*d* connecting to the antenna member. FIG. 15 is a schematic cross-sectional view that illustrates a state where dies brought into contact with the developing frame are clamped thereto in integrally molding the output conductive path and the antenna member to the developing frame according to the second embodiment. FIG. 16 schematically illustrates the integral electrode in the developing device according to the second embodiment.

The integral electrode 75 is formed in a space between the developing frame 44 and each of the dies 27 and 28. The integral electrode is integrally molded to the developing frame 44 by injection of a conductive resin from the gate 33 into an integral electrode forming section, which is the space for forming the integral electrode 75. Here, the integral electrode forming section is the space between the developing frame 44 and each of the dies 27 and 28 formed by bringing the dies 27 and 28 into contact with the developing frame 44 and the space inside the developing frame 44 into which the resin is injected. In the present embodiment, the single gate is used. However, a plurality of gates, for example, three or four gates, may be used in integrally molding. It is necessary to bring the dies 27 and 28 into contact with the developing frame 44 and clamp them in forming the integral electrode 75. The backup members 31 and 32 support the developing frame 44 from the backsides of the contact surfaces to the respective dies.

Integrally molding the output conductive path and the antenna member eliminates variations in the positional tolerance in the contacting section occurring when they are separately provided. In addition, the integral molding can ensure conduction more reliably and can reduce the number of parts and the number of steps necessary for production. Thus an inexpensive accurate configuration of detecting the remaining amount can be provided. In the present embodiment, an integrally molding method of injecting a resin into a frame after molding is used. However, an insert molding method or coinjection molding method performed in the same mold at the time of molding the frame may also be used.

As a variation of the second embodiment, a configuration in which the three elements of the output conductive path, the antenna member, and the contact electrode are integrally molded may be used.

(Variation)

Figure 17:
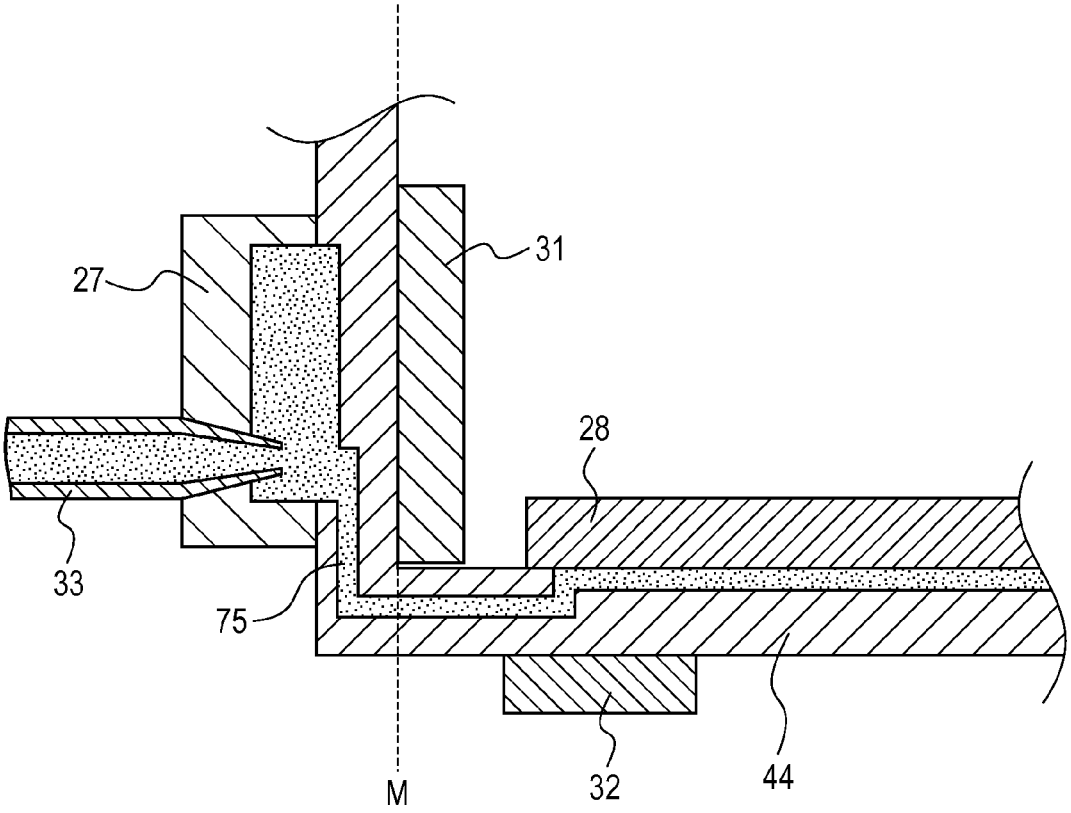
FIG. 17 is a schematic cross-sectional view that illustrates a state where the dies brought into contact with the developing frame is clamped thereto in integrally molding the integral electrode to the developing frame according to a variation of the second embodiment.
Figure 18A:
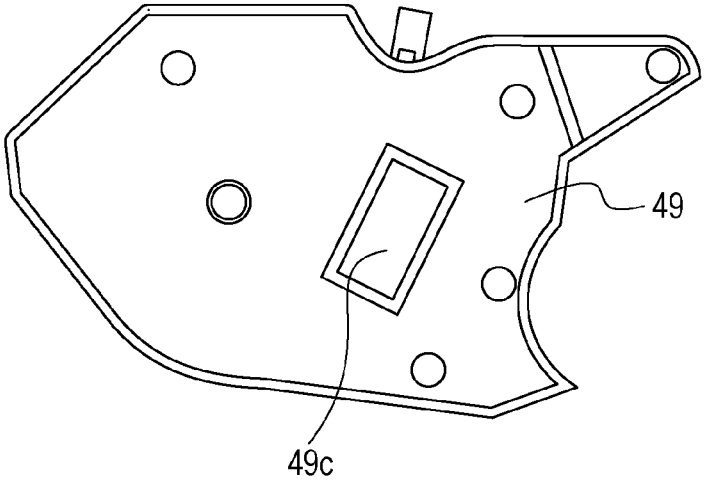
FIGS. 18A and 18B illustrate the developing frame of a side holder and a resin according to the variation of the second embodiment.
Figure 18B:
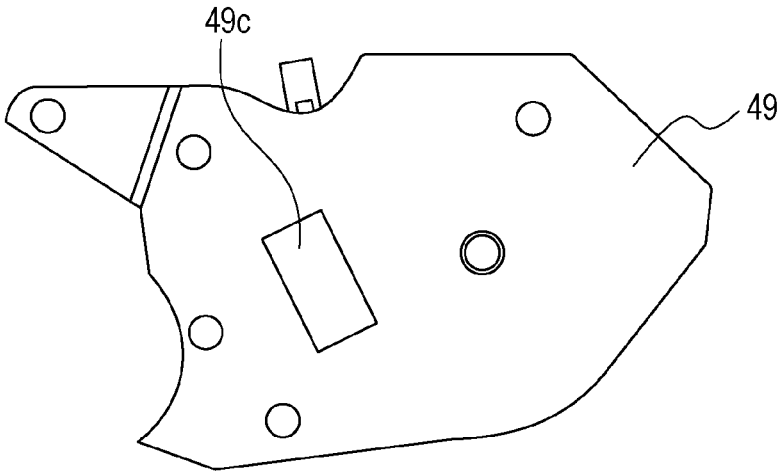

FIG. 17 is a schematic cross-sectional view that illustrates a state where the dies brought into contact with the developing frame are clamped thereto in integrally molding the output conductive path, the antenna member, and the contact electrode to the developing frame according to a variation of the second embodiment. FIG. 18A illustrates an inner portion of a side holder resin-bonded to the developing frame in the variation. FIG. 18B illustrates an outer portion of the side holder not resin-bonded to the developing frame in the variation.

In the variation, the integral electrode 75 is a member in which the three elements of the output conductive path, the antenna member, and the contact electrode are integrally molded. The integral electrode 75 is formed in a space between the developing frame 44 and each of the dies 27 and 28. The integral electrode is integrally molded to the developing frame 44 by injection of a conductive resin from the gate 33 into an integral electrode forming section, which is the space for forming the integral electrode 75. Here, the integral electrode forming section is the space between the developing frame 44 and each of the dies 27 and 28 formed by bringing the dies 27 and 28 into contact with the developing frame 44 and the space inside the developing frame 44 into which the resin is injected. It is necessary to bring the dies 27 and 28 into contact with the developing frame 44 and clamp them in forming the integral electrode 75. The backup members 31 and 32 support the developing frame 44 from the backsides of the contact surfaces to the respective dies.

The side holder 49 has a hole 49*c* allowing the integral electrode 75 to be exposed through the side holder. Part of the integral electrode 75 is exposed through the hole 49*c* and can come into contact with the contact point in the main body of the image forming apparatus.

Integrally molding the three elements of the output conductive path, the antenna member, and the contact electrode can reduce the number of parts relating to the contact electrode and simplify the structure, in comparison with the second embodiment. In the present embodiment, an integrally molding method of injecting a resin into a frame after molding is used. However, a configuration in which after the output conductive path and the antenna member are formed by an insert molding method, the contact electrode is integrally molded by injection of a resin into the frame may be used.

Third Embodiment

Figure 19:
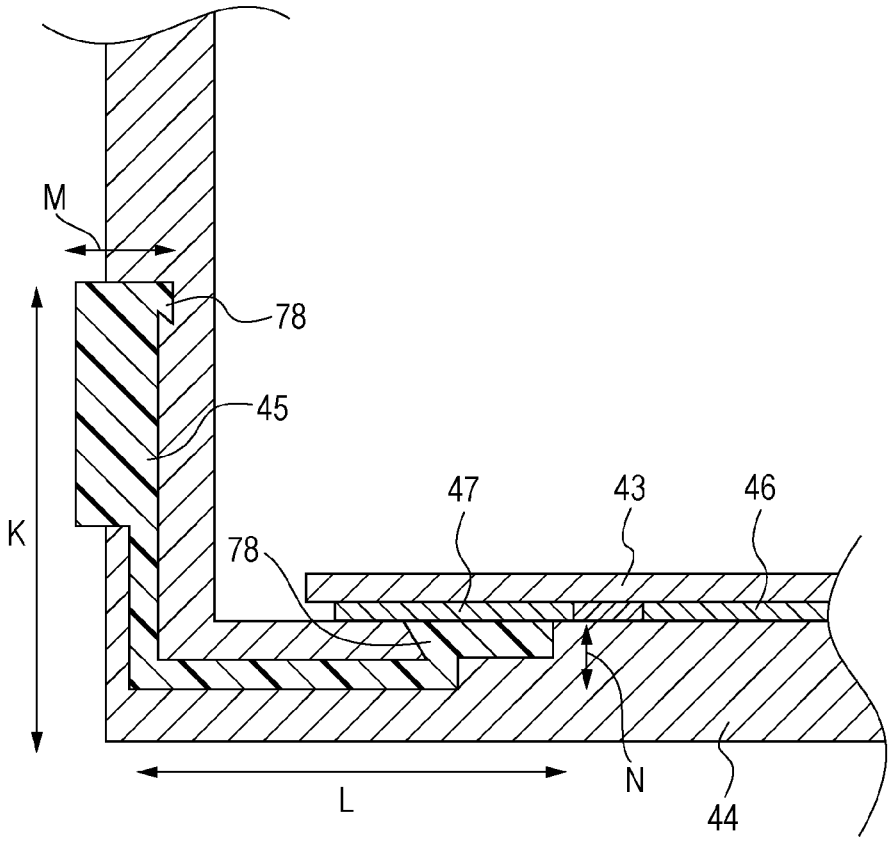
FIG. 19 is a schematic cross-sectional view of the developing device and the output conductive path according to a third embodiment.

FIG. 19 is a schematic cross-sectional view of the output conductive path and the developing frame according to a third embodiment. The present embodiment is characteristic in the directions in which the output conductive path 45, which is integrally molded to the developing frame 44, is positioned with respect to the developing frame 44 and the developing sleeve 41, in comparison with the first embodiment. The other respects are substantially the same as in the first embodiment, and redundant respects are not described.

The output conductive path 45 in the present embodiment is molded by injection of a conductive resin between the developing frame 44 and each die, as in the first embodiment. The temperature of the resin used in the injection of the conductive resin is at or above a temperature where the resin melts, and the melted resin of 170° C. is injected. Thus in molding the output conductive path 45, the resin contracts to the time at which the injected resin is cooled to a normal temperature. The stray capacitance is determined by the distance between the developing sleeve 41 and the surface of the output conductive path 45 near the developing sleeve 41. Accordingly, fixing the output conductive path 45 such that the surface of the output conductive path 45, which includes the resin, near the developing sleeve 41 is in contact with the developing frame 44 can reduce variations in the stray capacitance. In the following description, the fixation in the state where the resins are in contact with each other is referred to as contact-fixing. In the present embodiment, the integral electrode 75 includes an anchor shape 78 for contact-fixing the surface of the output conductive path 45, which includes the resin, near the developing sleeve 41 and the developing frame 44. The anchor shape 78 employs the fact that the size of the contraction of the resin increases with an increase in the width of the resin. The longer dimensions K and L of the output conductive path 45 contract more largely than the shorter dimensions M and N. Because of the above-described characteristic, the output conductive path 45 contracts in the directions of the longer dimensions K and L, and the anchor shape 78 presses the output conductive path 45 against the developing frame 44 toward the developing sleeve 41. As a result, a portion of the output conductive path 45 near the developing sleeve 41 is contact-fixed to the developing frame 44.

Figure 20:
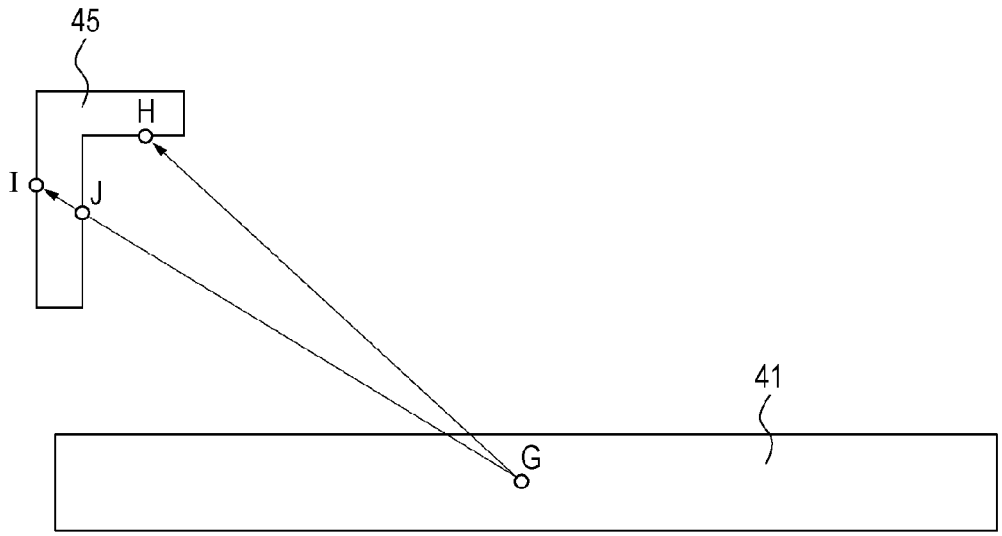
FIG. 20 is an illustration for describing a surface of the output conductive path near the developer bearing member according to the third embodiment.

Here, the surface of the output conductive path near the developing sleeve 41 is described with reference to FIG. 20. FIG. 20 is a model diagram for describing the surface of the output conductive path 45 near the developing sleeve 41. The surface of the output conductive path 45 near the developing sleeve 41 indicates a surface of a set of points on the surface of the output conductive path 45 such that no surface of the output conductive path 45 is present on the lines extending between the center of the developing sleeve 41 and the respective points. In FIG. 20, no surface of the output conductive path 45 is present on the line extending between the point G being the center of the developing sleeve 41 and the point H on the surface of the output conductive path 45. Thus the point H is a point on the surface of the output conductive path 45 near the developing sleeve 41. In contrast, the point J on the surface of the output conductive path 45 is present on the line extending between the point G being the center of the developing sleeve 41 and the point I on the surface of the output conductive path 45. Accordingly, the point I is not a point on the surface of the output conductive path 45 near the developing sleeve 41. The set of the points, including the point H, in which no surface of the output conductive path 45 is present on the lines extending from the respective points to the center of the developing sleeve 41 constitutes the surface of the output conductive path 45 near the developing sleeve 41.

Methods of contact-fixing the surface of the output conductive path 45 near the developing sleeve 41 to the developing frame 44 other than the method using the anchor shape 78 in the third embodiment may also be employed. For example, a method using an anchor effect by employing minute projections and depressions in the surface of the developing frame to which the output conductive path 45 wants to be contact fixed or a configuration in which an adhesive material is disposed between the developing frame and the molded output conductive path may also be used. A shape in which the output conductive path has an intentionally formed warp and is pressed against the developing frame may also be used.

Fourth Embodiment

Figure 21:
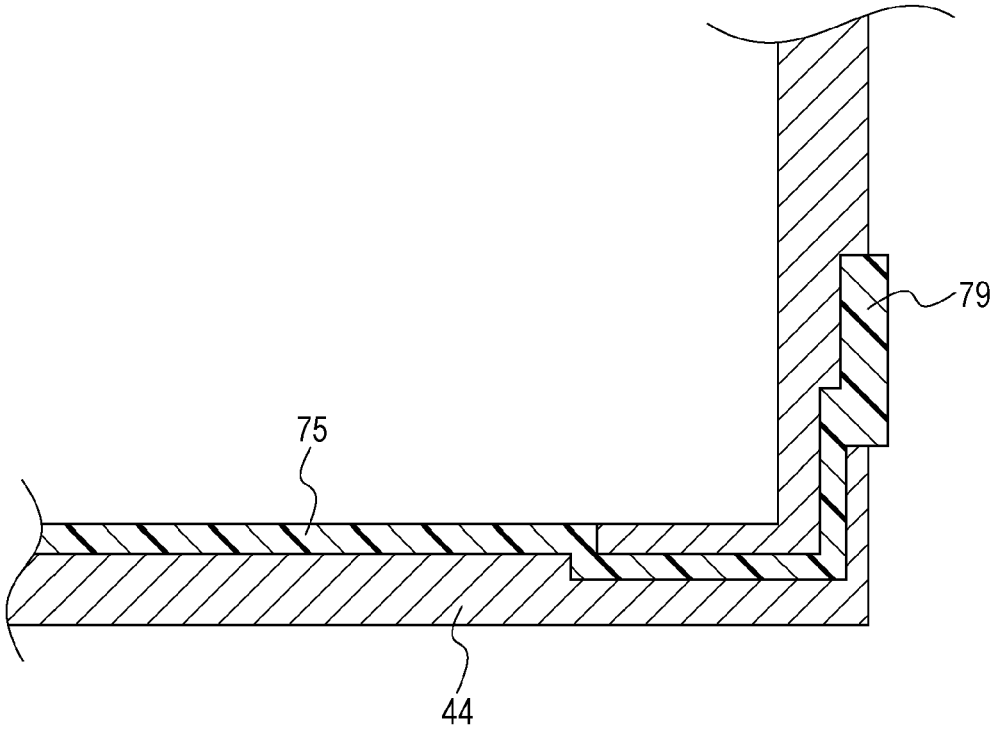
FIG. 21 is a schematic cross-sectional view of the output conductive path and the developing frame according to a fourth embodiment.
Figure 22A:
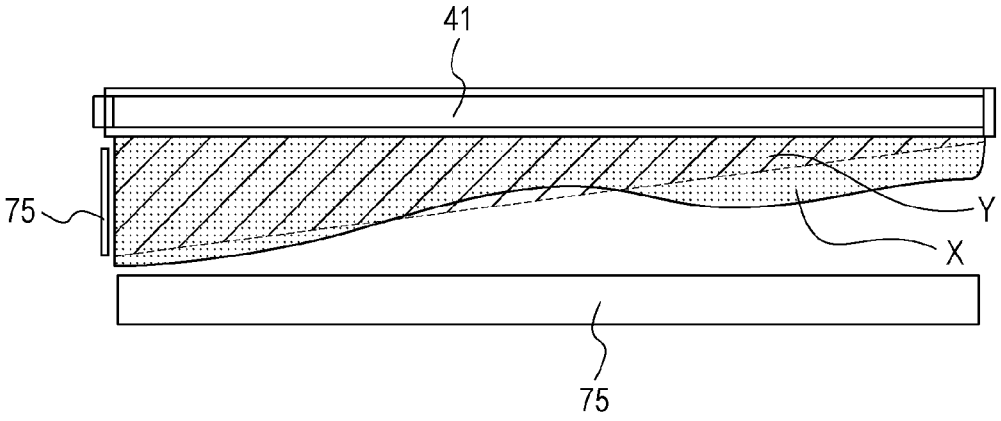
FIGS. 22A and 22B illustrate positions of the developer bearing member and the integral electrode when there is an imbalance in the toner according to the second embodiment.
Figure 22B:
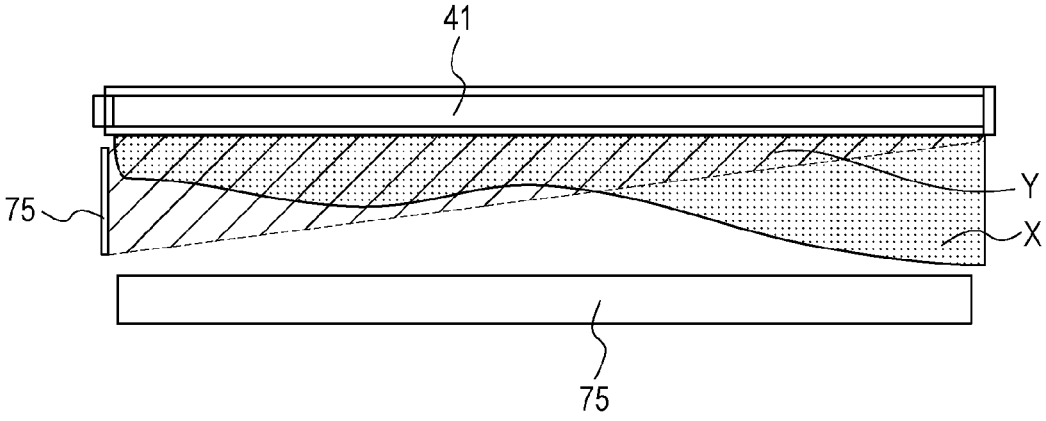

FIG. 21 is a schematic cross-sectional view of the output conductive path and the developing frame according to a fourth embodiment. FIGS. 22A and 22B are schematic cross-sectional views of the output conductive path and the developing frame according to the second embodiment. The present embodiment is characteristic in an end of the integral electrode 75 integrally molded to the developing frame 44 on a side that is not in contact with the contact electrode 48. The other respects are substantially the same as in the second embodiment, and redundant respects are not described.

The integral electrode 75 in the present embodiment includes a correction electrode (second conductive path) 79 at an end on a side that is not in contact with the contact electrode 48 along the longitudinal direction of the antenna member. The correction electrode 79 has substantially the same shape as that of an end being in contact with the contact electrode 48. The contact electrode 48 and the correction electrode extend in a direction intersecting the longitudinal direction of the antenna member, and the antenna member is disposed therebetween.

The correction electrode (second conductive path) 79 is part of the integral electrode 75 and is molded by injection of the conductive resin between the developing frame 44 and each die, as in the first embodiment. The use of the correction electrode 79 can reduce variations in the stray capacitance varying with respect to the longitudinal imbalance in the toner inside the developing chamber 61. The details are described below.

Figure 23A:
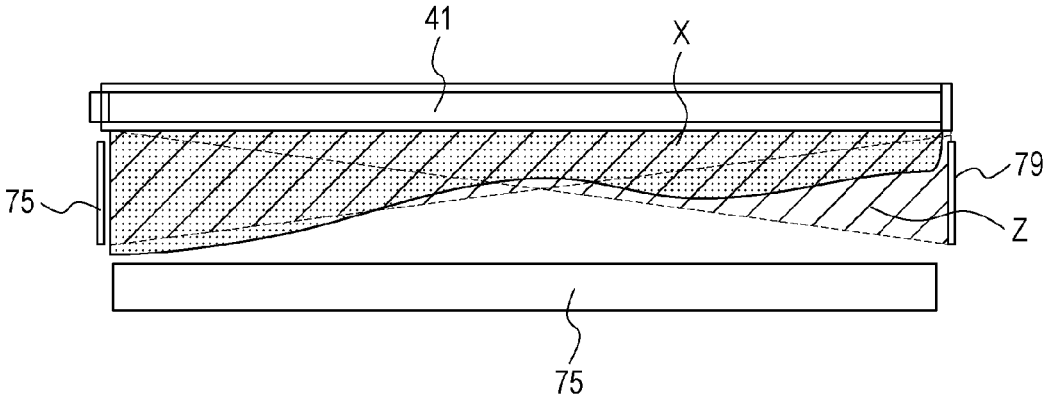
FIGS. 23A and 23B illustrate positions of the developer bearing member and the integral electrode when there is an imbalance in the toner according to the fourth embodiment.
Figure 23B:
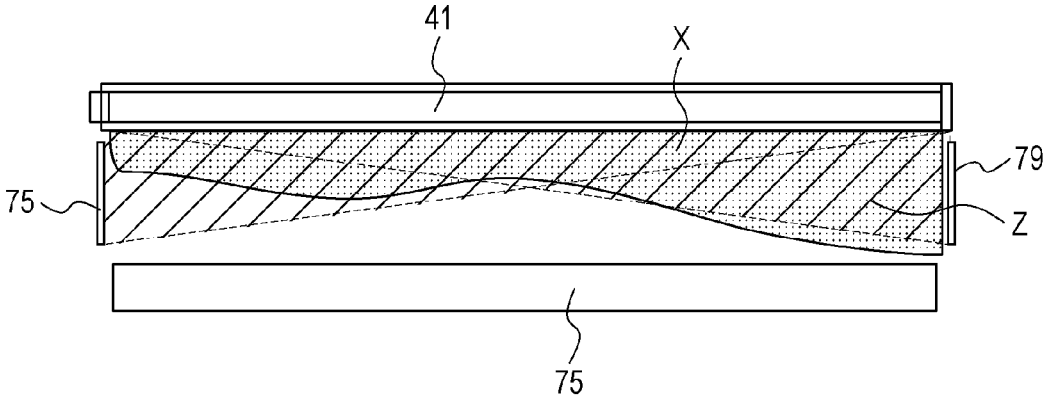

FIGS. 22A and 22B illustrate positions of the developing sleeve and the integral electrode when there is an imbalance in the toner according to the second embodiment. FIG. 22A illustrates a state where there is an imbalance in the toner near the contact electrode, and FIG. 22B illustrates a state where there is an imbalance in the toner on its opposite side. FIGS. 23A and 23B illustrate positions of the developing sleeve and the integral electrode when there is an imbalance in the toner according to the fourth embodiment. FIG. 23A illustrates a state where there is an imbalance in the toner near the contact electrode, and FIG. 23B illustrates a state where there is an imbalance in the toner on its opposite side. A hatched region Y is a region where the capacitance is detected as the stray capacitance in the second embodiment. A hatched region Z is a region where the capacitance is detected as the stray capacitance in the fourth embodiment. A dotted region X indicates how the toner is unbalanced. The amounts of the toners in FIGS. 22A and 22B are the same, and the amounts of the toners in FIGS. 23A and 23B are the same. Thus the detected stray capacitance may be the same. The region Z can deal with a wider range with respect to the imbalance of the toner than the region Y. Accordingly, the fourth embodiment can have smaller variations in the detected stray capacitance than the second embodiment for various cases where the same amount of the toner is unbalanced. The correction electrode is not limited to the above-described shape and may have another shape that can suppress variations in the detected stray capacitance detected by the output conductive path (part of the integral electrode) with respect to the same amount of the toner. The correction electrode 79 can be formed by integrally molding as part of the integral electrode to the developing frame 44 without having to increase the number of parts and steps.

[Others]

Figure 24:
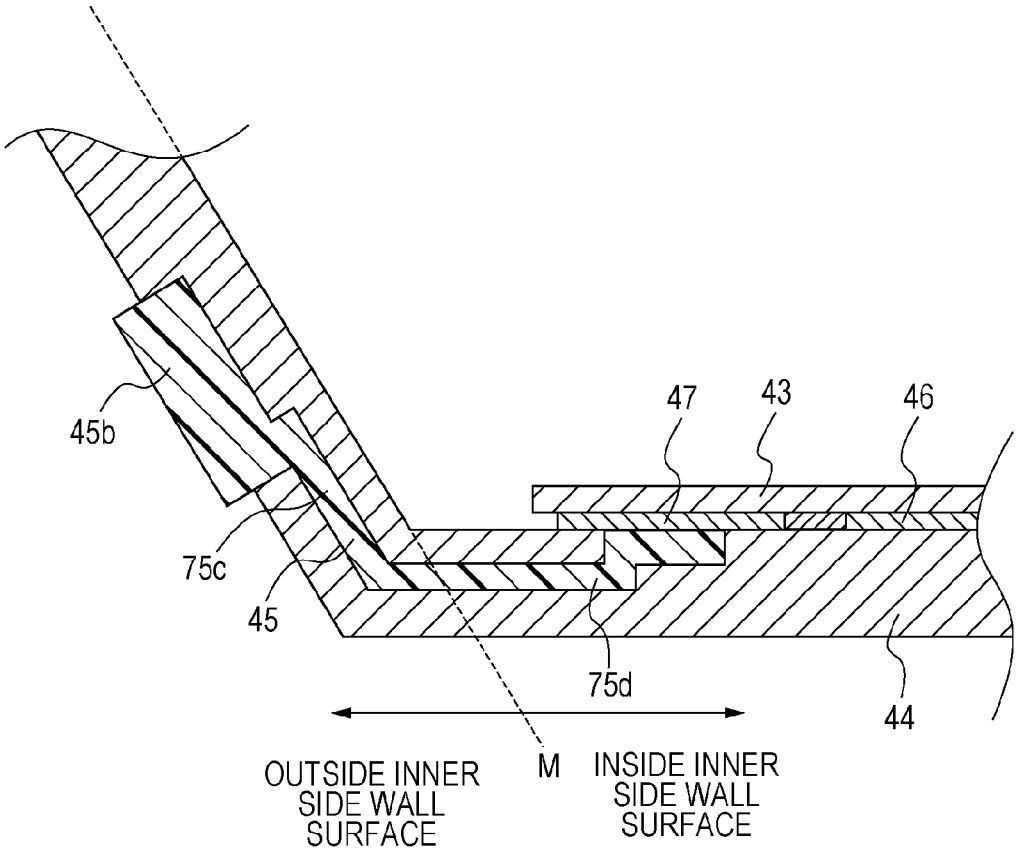
FIG. 24 is a schematic cross-sectional view of the output conductive path and the developing frame.

In the foregoing description, the inner side wall surface of the frame intersecting the longitudinal direction of the detecting member is perpendicular thereto. The inner side wall surface may be inclined, as illustrated in FIG. 24. In this case, an imaginary plane may be formed by extension of the inclined surface, a path positioned outside the imaginary plane may be a conductive path 75*c* including the resin. As illustrated in FIG. 24, a conductive path 75*d* extending to the antenna member is also necessary to make conduction with the antenna member. The conductive path 75*d* is connected to the antenna member through the end of the conductive path and the conductive two-sided adhesive tape.

In the integral molding, the conductive path, the detecting member, the contacting section, and the contact electrode are described as being integrally molded. A combination of them may be selected depending on what is produced. For example, the frame may be integrally molded to at least one of the detecting member, the conductive path, and the contacting section depending on the use.

As another example, integrally molding the frame to at least one of the detecting member, the conductive path, and the contact electrode may also be used.

In the description of the present embodiment, a configuration in which the conductive path in the developing device includes a resin is described. However, there is a case where the developer bearing member is not provided and the developer container for accommodating a developer is also provided with a mechanism for detecting the amount of the developer. In that case, an application to the developer container may also be used. Part of the developing device in the present embodiment may be considered as the developer container.

Fifth Embodiment

Figure 25A:
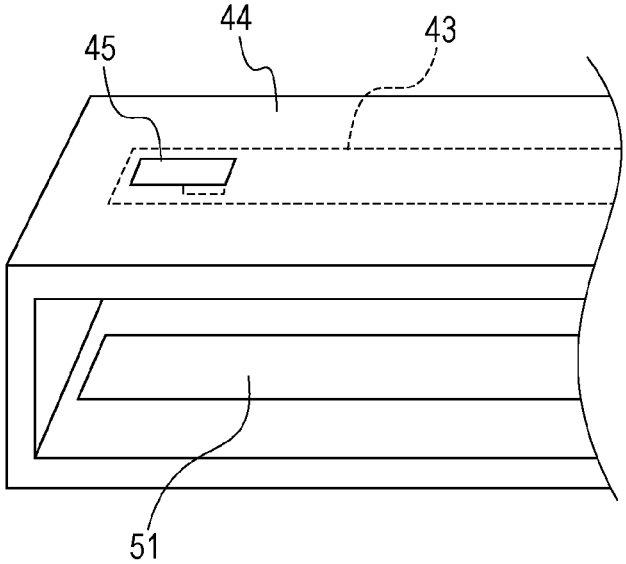
FIGS. 25A and 25B are schematic illustrations for describing the output conductive path and the developing frame according to a fifth embodiment.
Figure 25B:
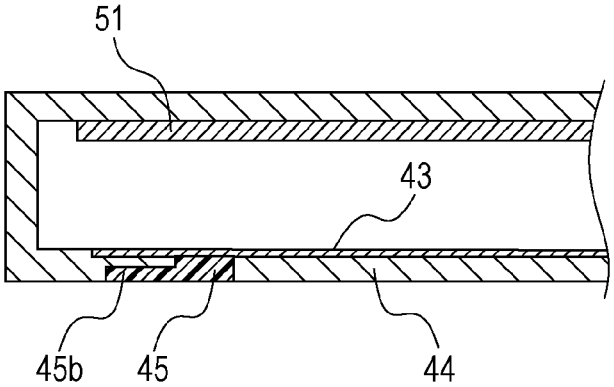
Figure 26A:
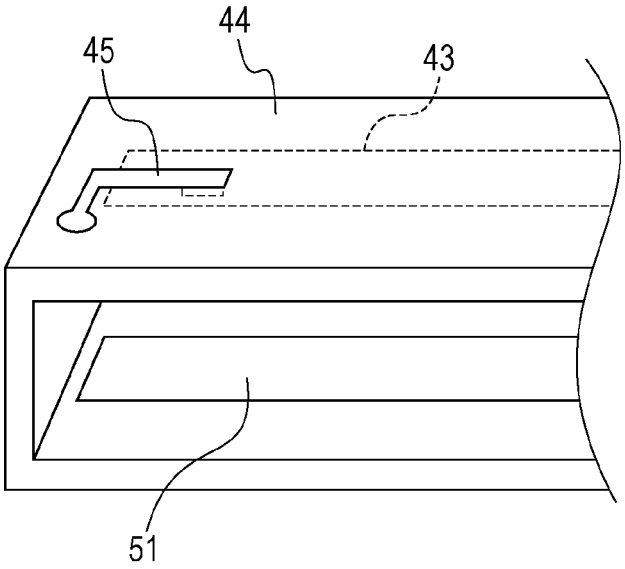
FIGS. 26A and 26B are schematic illustrations for describing the output conductive path and the developing frame according to the fifth embodiment.
Figure 26B:
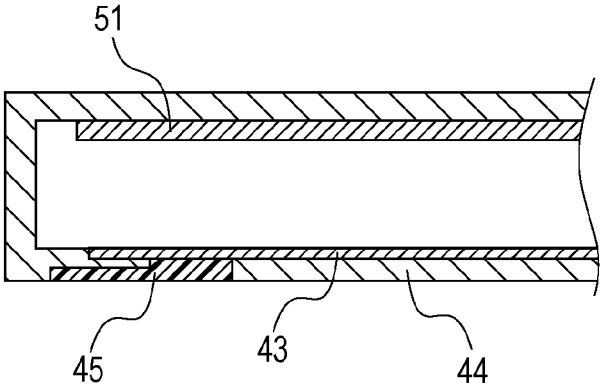
Figure 27A:
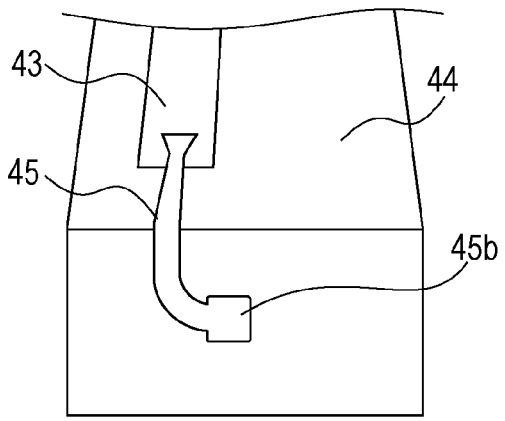
FIGS. 27A and 27B are schematic illustrations for describing the output conductive path and the developing frame according to the fifth embodiment.
Figure 27B:
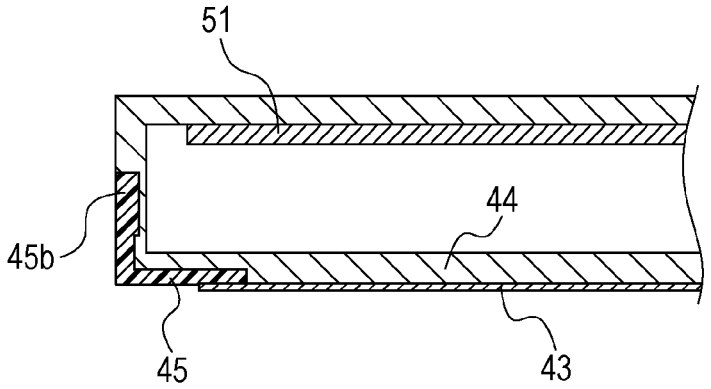

Next, a fifth embodiment of the present invention is described with reference to FIGS. 25A to 27B. FIG. 25A is a schematic perspective view that illustrates an example arrangement of the output conductive path 45 according to the fifth embodiment, and FIG. 25B is a cross-sectional view thereof. FIG. 26A is a schematic perspective view that illustrates another example arrangement of the output conductive path 45 according to the fifth embodiment, and FIG. 26B is a cross-sectional view thereof. FIG. 27A is a schematic perspective view that illustrates still another example arrangement of the output conductive path 45 according to the fifth embodiment, and FIG. 27B is a cross-sectional view thereof.

The present embodiment describes an arrangement of the output conductive path and the antenna member different from that in the first embodiment. The other fundamental configuration is substantially the same as in the first embodiment, and redundant respects are not described.

In the present embodiment, as illustrated in FIG. 25B, the output conductive path 45 is integrally molded onto the developing frame 44 using the conductive resin such that there is conduction between the output conductive path 45 and the antenna member 43 disposed on part of the inner bottom surface of the developing frame 44. At this time, a method of making conduction between the antenna member 43 and the output conductive path 45 may be achieved using direct contact or through conductive two-sided adhesive tape because merely the conduction is ensured. A configuration that uses direct contact may be more useful than that using the two-sided adhesive tape because such tape causes a tolerance or the like. The output conductive path 45 is formed such that it passes through the inside of the developing frame 44 and its part is exposed to the outside of the developing frame 44. Part of the exposed section includes the contact-electrode contacting section 45*b* for being in contact with an outside contact and establishing electrical connection.

In the present embodiment, an electrode 51 for detecting the amount of the developer using the capacitance is disposed on a location opposed to the antenna member 43, and the capacitance between the antenna member 43 and the electrode 51 is measured.

As an example arrangement of the output conductive path 45 in the present embodiment, as illustrated in FIGS. 25A and 25B, a case where the whole of the output conductive path 45 is within the region (range) where the antenna member 43 is disposed as viewed from the thickness direction of the antenna member 43 is discussed. In that case, because the output conductive path 45 is hidden behind the antenna member 43 as viewed from the electrode 51, there is no stray capacitance occurring between the electrode 51 described in the first embodiment (developing sleeve 41 in the first embodiment) and the output conductive path 45.

Next, another example arrangement of the output conductive path 45 in the present embodiment is described. As that example arrangement, as illustrated in FIGS. 26A and 26B, a case where part of the output conductive path 45 extends beyond the edge of the region (range) where the antenna member 43 is disposed as viewed from the thickness direction of the antenna member 43 is discussed. In that case, in addition to the capacitance between the antenna member 43 and the electrode 51, a stray capacitance occurs between the electrode 51 and the output conductive path 45.

Next, still another example arrangement of the antenna member 43 in the present embodiment is described. In the first embodiment, the antenna member 43 is near the developer container on the developing frame 44. As illustrated in FIGS. 27A and 27B, the antenna member 43 may be disposed outside the developing frame 44. In that case, in addition to the capacitance between the antenna member 43 and the electrode 51, a stray capacitance occurs between the electrode 51 and the output conductive path 45.

In the case where the output conductive path 45 is integrally molded onto the developing frame 44 using the conductive resin, as in the present embodiment, the coupling force between the materials can be ensured by selecting the material of the output conductive path 45 compatible with the material of the developing frame 44. In the case where a combination of incompatible materials is used, the conductive path may be formed using a combination of a direct path and a curved path, a combination of a corner and a circular shape, or a combination of different thicknesses, as illustrated in FIGS. 26A and 26B. This can enable a method of complementing the coupling force between the materials by causing the output conductive path 45 to bite the developing frame 44 because of its thermal contraction occurring in integrally molding using the conductive resin. There is another method of using a material having thermal adhesiveness in the output conductive path 45.

As described above, with the present embodiment, the structure can be simplified. In addition, the assembly process can be simpler and the positional accuracy and the assembly accuracy can be higher than those in the case where the metal plate is used in the conductive path and the external connection contacting section.

[Others]

The present invention can be used in not only the developer container for accommodating the developer but also the developing device including the developer bearing member (for example, developing roller) for bearing the developer. The configuration in which the developer is accommodated in the process cartridge including the image carrier and a pair of electrodes are arranged, as illustrated in FIG. 2, may also be used.

In the first embodiment, the configuration in which the single process cartridge is detachable is described. However, other configurations may also be used. For example, an application to an image forming apparatus including a plurality of detachable process cartridges may also be used.

An application to an image forming apparatus including a plurality of detachable developer containers and detachable developing devices may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-197215 filed Sep. 24, 2013 and No. 2014-152906 filed Jul. 28, 2014, which are hereby incorporated by reference herein in their entirety.

What is claimed is:

1. A developer container, comprising:
a frame for accommodating developer;
an electrode;
a detecting member, disposed on the frame, including a first resin; and
a conductive path, connected to the detecting member, including a second resin,
wherein an amount of developer is determined based on a first capacitance between the detecting member and the electrode and a second capacitance between the electrode and the conductive path.

2. The developer container according to claim 1, wherein the detecting member and the conductive path include the same resin.

3. The developer container according to claim 1, wherein part of the conductive path includes a first conductive path intersecting a longitudinal direction of the detecting member.

4. The developer container according to claim 3, wherein the first conductive path is perpendicular to the longitudinal direction of the detecting member.

5. The developer container according to claim 3, wherein part of the conductive path further includes a second conductive path intersecting the longitudinal direction of the detecting member, and
the detecting member is disposed between the first conductive path and the second conductive path.

6. The developer container according to claim 1, wherein the conductive path includes a contacting section or a contact electrode on a surface opposite a side wall surface, and the contacting section or the contact electrode is configured to establish electrical connection with another contact.

7. The developer container according to claim 6, wherein the frame is integrally molded to at least one of the detecting member, the conductive path, and the contacting section.

8. The developer container according to claim 6, wherein the frame is integrally molded to at least one of the detecting member, the conductive path, and the contact electrode.

9. A developing device comprising:
the developer container according to claim 6;
a second contact electrode configured to establish electrical connection with the contacting section; and
a developer bearing member configured to bear the developer.

10. The developer container according to claim 1, wherein the conductive path extends inside the frame.

11. The developer container according to claim 1, wherein the detecting member comprises a conductive resin sheet.

12. The developer container according to claim 1, further comprising the electrode disposed in a location opposed to the detecting member and configured to detect the amount of the developer using the first capacitance.

13. A developing device comprising:
the developer container according to claim 1; and
a developer bearing member configured to bear the developer.

14. The developing device according to claim 13, wherein the detecting member is located between the developer bearing member and an agitator.

15. The developing device according to claim 13, wherein the electrode is the developer bearing member and the first capacitance is a capacitance between the detecting member and the developer bearing member.

16. A process cartridge comprising:
the developer container according to claim 1; and
an image carrier configured to carry a developer image.

17. An image forming apparatus comprising:
the developer container according to claim 1; and
a transfer unit configured to transfer a developer image on a recording material.

18. The developer container according to claim 1, wherein at least part of the conductive path includes an exposed section exposed to a surface opposite a surface on which the detecting member is disposed.

19. The developer container according to claim 1, wherein the conductive path is arranged within a region that overlaps the detecting member in a thickness direction of the detecting member in a range where the detecting member is disposed.

20. The developer container according to claim 1, wherein at least part of the conductive path is arranged within a region that does not overlap the detecting member in a thickness direction of the detecting member in a range where the detecting member is disposed.

21. The developer container according to claim 1,
wherein the frame includes a third resin, and
wherein the second resin is compatible with the third resin.

22. The developer container according to claim 1,
wherein the frame includes a resin, and
wherein the conductive path and the frame are integrally formed by resin molding.

23. A developer container, comprising:
a frame for accommodating developer;
an electrode;
a detecting member, including a first resin; and
a conductive path, configured to propagate a detection signal detected by the detecting member, including a second resin,
wherein the frame has a side wall surface intersecting a longitudinal direction of the detecting member,
wherein at least part of the conductive path is positioned outside and on the side wall surface in the longitudinal direction, and
wherein an amount of developer is determined based on a first capacitance between the detecting member and the electrode and a second capacitance between the electrode and the conductive path.

24. A developing device comprising:
the developer container according to claim 23, and
a developer bearing member configured to bear the developer,
wherein the detecting member is located between the developer bearing member and an agitator.

25. The developing device according to claim 24, wherein the electrode is the developer bearing member and the first capacitance is a capacitance between the detecting member and the developer bearing member.

26. The developer container according to claim 23,
wherein the frame includes a third resin, and
wherein the second resin is compatible with the third resin.

27. The developer container according to claim 23,
wherein the frame includes a resin, and
wherein the conductive path and the frame are integrally formed by resin molding.

* * * * *